US008146520B2

(12) United States Patent
Polstra

(10) Patent No.: US 8,146,520 B2
(45) Date of Patent: Apr. 3, 2012

(54) APPARATUS AND METHOD FOR FEEDING STACKS OF MULTIPLE TAGS TO A SEWING MACHINE IN AUTOMATED CLOSURE AND TAGGING OF BAGS

(76) Inventor: Theunis Jsaper Polstra, Morell (CA)

( * ) Notice: Subject to any disclaimer, the term of this patent is extended or adjusted under 35 U.S.C. 154(b) by 336 days.

(21) Appl. No.: 12/470,190

(22) Filed: May 21, 2009

(65) Prior Publication Data

US 2010/0294184 A1 Nov. 25, 2010

(51) Int. Cl.
*D05B 13/00* (2006.01)

(52) U.S. Cl. ..... 112/11

(58) Field of Classification Search ..... 53/135.1, 53/135.2, 135.3; 112/11, 104, 152, 153, 112/113, 115, 470.14, 475.07, 475.08
See application file for complete search history.

(56) References Cited

U.S. PATENT DOCUMENTS

| | | | | |
|---|---|---|---|---|
| 2,815,899 | A | 12/1957 | Swanson | |
| 2,979,840 | A | 4/1961 | Eastman | |
| 3,008,436 | A * | 11/1961 | Golden | 112/104 |
| 3,071,369 | A | 1/1963 | Ambrogi | |
| 3,338,192 | A * | 8/1967 | King | 112/11 |
| 3,439,470 | A | 4/1969 | Brinkmeier | |
| 3,498,244 | A * | 3/1970 | Blanchette | 493/226 |
| 3,544,100 | A | 12/1970 | Desal et al. | |
| 3,616,093 | A * | 10/1971 | Teed | 156/571 |
| 3,805,716 | A | 4/1974 | Cerioni | |
| 4,157,692 | A | 6/1979 | Brocklehurst et al. | |
| 4,178,119 | A | 12/1979 | Busch | |
| 4,399,905 | A | 8/1983 | Lance et al. | |
| 4,441,442 | A * | 4/1984 | Robinson et al. | 112/256 |
| 4,505,467 | A | 3/1985 | Brocklehurst | |
| 4,590,872 | A | 5/1986 | Bray | |
| 5,238,307 | A | 8/1993 | Mooney et al. | |
| 5,350,167 | A | 9/1994 | Hansch | |
| 5,479,757 | A * | 1/1996 | Ogawa | 53/135.1 |
| 5,535,997 | A | 7/1996 | Croyle et al. | |
| 6,022,014 | A | 2/2000 | Rathert et al. | |
| 6,626,103 | B2 | 9/2003 | Neumann | |

FOREIGN PATENT DOCUMENTS

| | | |
|---|---|---|
| CA | 443039 | 7/1947 |
| CA | 406127784 A | 5/1994 |

OTHER PUBLICATIONS

Huntsman, Inc., ESP Express Scale Parts, date unknown.
Inpak Systems, Inc., Inglett: Hanging, Filling & Closing System Model 3597, date unknwon.

* cited by examiner

*Primary Examiner* — Tejash Patel
(74) *Attorney, Agent, or Firm* — Kyle R. Satterthwaite; Ryan W. Dupuis; Ade & Company, Inc.

(57) ABSTRACT

A tag feeding apparatus for use with a bag-closing and tag-applying sewing machine in order to attach multiple tags to each bag in a sequence of bags delivered to the sewing machine for closing of each bag and simultaneous attachment of the multiple tags by sewing the bag and the multiple tags together along edges of the bag at an opening thereof. A tag spreader of the apparatus is arranged to receive a stack of a plurality of different tags that are distinct from one another and stacked together in a face-to-face grouping and is arranged to displace the different tags relative to one another along faces of the tags to project each tag partially outward from an adjacent tag next thereto in the grouping of tags. The presence of each tag on the closed bag is easily confirmed visually by the projection of one tag outward from the others.

27 Claims, 20 Drawing Sheets

D
606
602
604
608
600
510
512
500

606b
608b
604b
602b
608c
606c
604c
602c
602a
604a
606a
608a
602d
604d
606d
608d
600

APPARATUS AND METHOD FOR FEEDING STACKS OF MULTIPLE TAGS TO A SEWING MACHINE IN AUTOMATED CLOSURE AND TAGGING OF BAGS

FIELD OF THE INVENTION

This invention relates generally to systems for automatic feeding bags of product one at a time through a sewing machine with one or more tags or labels per bag to effect simultaneous closure of the bag and attachment of the tag(s) thereto, and more particularly to a tag feeding apparatus for such a system arranged to deliver a stack of multiple tags in a spread out condition for each bag to enable visual confirmation of the presence of each tag on the closed bag.

BACKGROUND OF THE INVENTION

Systems for sequentially feeding individual open bags of a granular product such as seed or animal feed to the head of a sewing machine after placing a tag at the mouth or opening of the bag to both close the mouth of the bag and attach the tag to the mouth of the bag through a single stitching action are known in the packaging industry. Examples of two such systems are disclosed in U.S. Pat. No. 3,805,716 of Cerioni and U.S. Pat. No. 5,479,757 of Ogawa. These two prior art systems are each arranged to deliver a single tag or label for each bag being conveyed to the sewing machine. The Fischbein 3920 dual tag placer is capable of feeding or conveying two tags or labels onto each bag for simultaneous connection thereto in the same bag-closing stitching action. However, the tags are placed side by side on the bag and therefore may occupy a significant fraction of the surface area of the face or side of the bag on which they are placed. It some cases, it is desirable to leave an area open for receipt of other labeling or marking directly on the bag, for example by ink printing onto the bag itself.

Applicant is unaware of any prior developments in this field facilitating automated feeding of more than two tags for attachment to a single bagged product or facilitating feeding of two tags in a more space-efficient configuration than the machine identified above.

SUMMARY OF THE INVENTION

According to a first aspect of the invention there is provided a tag feeding apparatus for use with a bag-closing and tag-applying sewing machine in order to attach multiple tags to each bag in a sequence of bags delivered to the sewing machine for closing of each bag and simultaneous attachment of the multiple tags by sewing the bag and the multiple tags together along edges of the bag at an opening thereof, the tag feeding apparatus comprising a tag spreader arranged to receive a stack of tags comprising a plurality of different tags that are distinct from one another and stacked together in a face-to-face grouping and arranged to displace the different tags relative to one another along faces of the tags to project each tag partially outward from an adjacent tag next thereto in the grouping of tags.

Preferably the tag spreader comprises first and second frictional gripping members arranged face-to-face to receive and frictionally grip the grouping of tags between facing surfaces of the gripping members, the first and second gripping members being driven to displace the facing surfaces of the gripping members relative to one another along the facing surfaces to shift the tags frictionally gripped between the facing surfaces relatively to one another to displace the different tags relative to one another along the faces of the tags to project each tag partially outward from the adjacent tag in the grouping.

Preferably the tag spreader comprises first and second belts entrained about first and second pulley sets to position the first and second belts face-to-face for movement along a common delivery path defined between face-to-face portions of the first and second belts, the first and second belts being arranged to receive the grouping of tags between the face-to-face portions and be driven to respectively travel unequal first and second distances along the delivery path in a set amount of time to move the grouping of tags along the delivery path and shift the tags relatively to one another along the delivery path to displace the different tags relative to one another along the faces of the tags to project each tag partially outward from the adjacent tag.

Preferably the first and second belts are arranged to be driven at equal speeds along the delivery path and the delivery path is non-linear so that at least a portion of the delivery path curves or approximate a curve.

Preferably the first and second pulley sets are movably carried on a frame of the tag spreader and selectively lockable to the frame in different positions to reconfigure the delivery path.

Preferably the tag spreader comprises support members movably carried on a frame of the tag spreader and selectively lockable to the frame in different positions to reposition pulleys of the first and second pulley sets.

Preferably pulleys of the first and second pulleys sets alternate along the delivery path.

Preferably there is provided a tag stacker arranged to retrieve the different tags from respective tag sources and stack the different tags atop one another face-to-face to define the stack of tags, and a tag turner arranged to receive the stack of tags from the tag stacker and position the grouping of tags to extend upright prior to receipt thereof by the tag spreader.

Preferably the tag turner comprises a first pulley pair, a second pulley pair, a first twisted belt entrained about the first pulley pair and a second twisted belt entrained about the second pulley pair, each pulley pair comprising spaced apart input and output pulleys supported for rotation about input and output axes respectively which are angularly offset from one another by a same angle, the input pulleys being positioned adjacent one another with the inlet axes parallel and the output pulleys being positioned adjacent one another with the outlet axes parallel and more upright than the inlet axes, and the twisted belts jointly twisting through the same angle from the input pulleys to the output pulleys and extending face-to-face with one another from between the input pulleys to between the output pulleys to receive the different tags stacked atop one another between the twisted belts at the inlet pulleys and convey the grouping of tags to the outlet pulleys while pivoting them through the same angle as the twisting of the twisted belts to reposition the tags upright.

Preferably the output axes are vertical.

Preferably the tag stacker comprises a plurality of tag dispensers spaced along a conveyer and each arranged to deliver individual tags one at a time from a source of a respective one of the different tags onto a respective slotted tag tray above the conveyor, the conveyor having upward projections positioned thereon to move through slots in the trays under operation of the conveyor to force a first individual tag off the respective tray of a first tag dispenser and move the first individual tag onward beneath the respective tray of a second tag dispenser where the projections move the first and second individual tags onward together, forcing the second individual tag off the respective tray of the second dispenser onto the first individual tag below.

Preferably the trays and surfaces onto which the first individual tag falls from the respective tray of the first tag dispenser slope downwardly away from the tag dispensers to position the tags against wall portions projecting upward from the trays and the surfaces at distances from the dispensers to define guides for aligning edges of the tags prior to receipt thereof by the tag spreader.

Preferably the conveyor comprises at least one endless flexible element entrained about rotatable members and the surfaces onto which the first tag falls are defined above the conveyor and separated along the conveyor by one or more additional slots through which the projections extend upward to contact and move the tags.

Preferably the flexible element comprises a chain and the rotatable members comprise sprockets.

Preferably the conveyor and the tag spreader are both coupled to a common motor for driven operation thereby.

According to a second aspect of the invention there is provided a tag feeding apparatus for use with a bag-closing and tag-applying sewing machine in order to attach multiple tags to each bag in a sequence of bags delivered to the sewing machine for closing of each bag and simultaneous attachment of the multiple tags by sewing the bag and the multiple tags together along edges of the bag at an opening thereof, the tag feeding apparatus comprising:

a tag spreader arranged to receive a stack of tags comprising a plurality of different tags that are distinct from one another and stacked together in a face-to-face grouping, the tag spreader comprising first and second belts entrained about first and second pulley sets to position the first and second belts face-to-face for movement along a common delivery path defined between face-to-face portions of the first and second belts, the first and second belts being arranged to receive the grouping of tags between the face-to-face portions and be driven to move the grouping of tags along the delivery path and shift the tags relatively to one another along the delivery path to displace the different tags relative to one another along the faces of the tags to project each tag partially outward from the adjacent tag.

According to a third aspect of the invention there is provided a method of closing bags and applying multiple tags thereto, the method comprising the steps of:

(a) providing a plurality of different tags that are distinct from one another;

(b) arranging the plurality of different tags in a face-to-face grouping;

(c) displacing the different tags in the grouping relative to one another along faces of the tags to project each tag partially outward from an adjacent tag next thereto in the grouping of tags;

(d) feeding the grouping of tags and a respective bag into a bag-closing sewing machine; and (e) running the sewing machine to stitch the grouping of tags to the respective bag along a previously open end of the bag to simultaneously close the bag and attach the grouping of tags thereto.

Preferably there is provided the additional step of visually confirming the presence of an outermost tag having a next tag positioned partially therebehind in the grouping of tags attached to the respective bag and confirming the presence of the next tag by visually recognizing a projection of the next tag outwardly past a perimeter edge of the outermost tag.

BRIEF DESCRIPTION OF THE DRAWINGS

In the accompanying drawings, which illustrate exemplary embodiments of the present invention:

FIG. 13 is an isometric view of a pulley support assembly used in the tag turning section of the apparatus.

DETAILED DESCRIPTION

Figure 1:
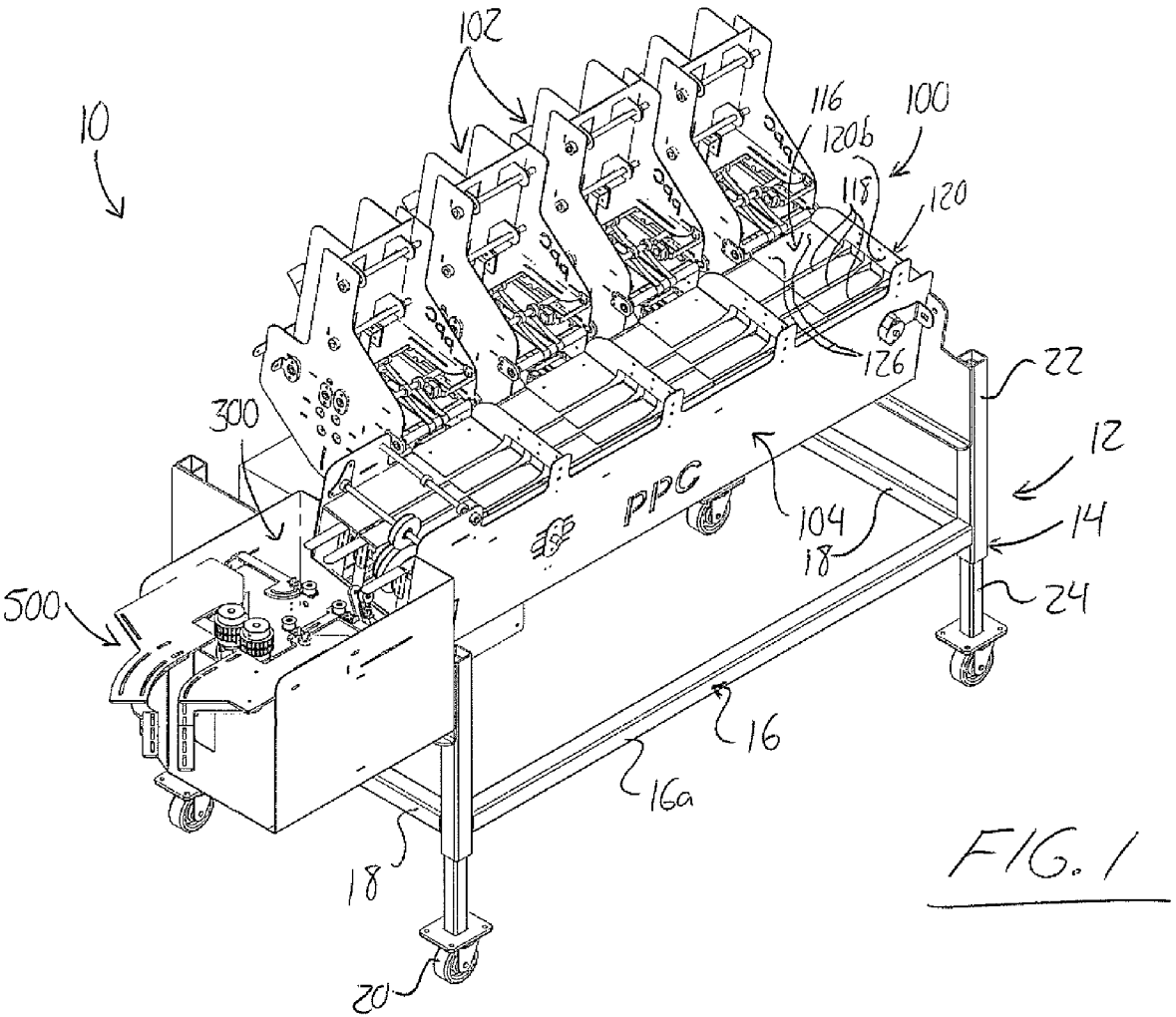
FIG. 1 is a front isometric view of a tag feeding apparatus according to the present invention prior to installation of conveying belts and chains.
Figure 2:
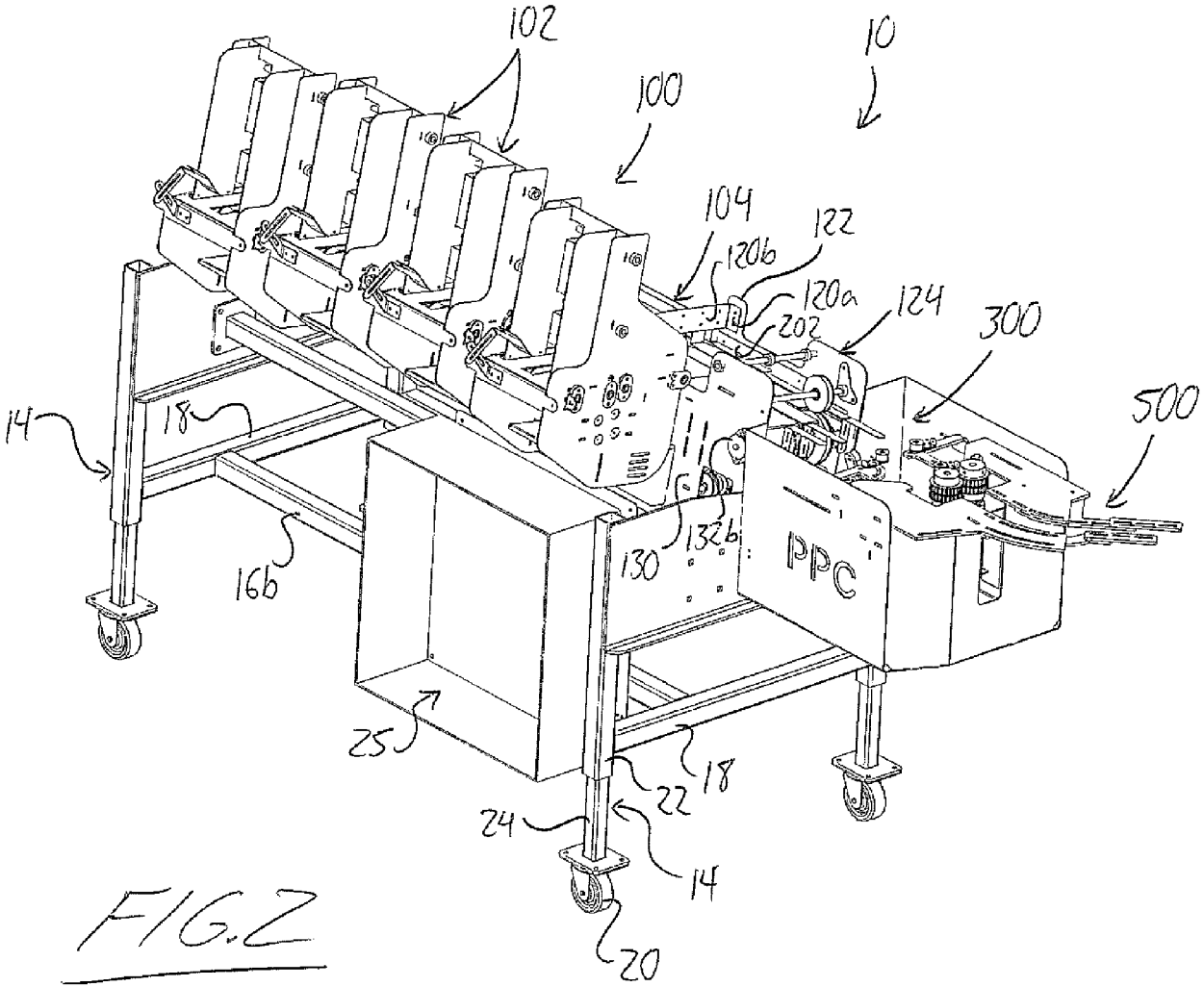
FIG. 2 is a rear isometric view of the tag feeding apparatus.

FIGS. 1 and 2 show a tag feeding apparatus 10 having a tag stacking section 100, a tag turning section 300 and a tag spreading section 500. The tag stacking section 100 features a plurality of tag dispensers 102 that each draws from a respective stack of identical tags to deliver the tags one at a time to a conveyor assembly 104 adjacent which the tag dispensers 102 are positioned. The tags delivered by the different tag dispensers 102 are different from one another, each thus providing one a plurality of different tags to be attached to an individual bag of product, for example a granular product such as seed or animal feed. The conveyor assembly 104 functions to gather together individual tags, one of each type, and arrange them in a stacked condition one atop the other in a face-to-face manner. The tag turning section 300 receives the stacked tags from the tag stacking section 100, and turns the stack through a predetermined angle to reposition the stack in a vertically upstanding orientation from its originally more horizontal tag-upon-tag configuration. The tag turning section delivers the tags to the tag spreading section 500, where the stack of tags is spread out so that each tag projects partially outward from the next where the tags exit the apparatus for receipt in a bag-closing sewing machine. This way, the tags are sewn on the bag in this spread out or splayed manner so that the presence of each tag on the closed and tagged bag is visibly identifiable.

The different sections of the apparatus are carried on a common frame 12 so as to be elevated above a ground surface on which the frame is disposed. The frame comprises four vertical legs 14 situated at four corners of an elongated rectangular horizontal area, with lengthwise rails 16 and widthwise rails 18 interconnecting the legs part way thereup along the boundaries of the rectangular area. The vertical legs 14 have caster wheels 20 mounted at the bottom ends thereof to enable easy transport and positioning of the apparatus 10. The vertical legs are each a two-piece telescoping structure having an outer member 22 of hollow square tubing receiving an inner elongate member 24 of square cross-section telescopically received therein to depend downward therefrom and lockable thereto at different positions therealong to allow adjustment of the height of the frame 12, the rail members 16, 18 of the frame being fixed to the outer leg member 22 above the open bottom end thereof. A front lengthwise rail 16*a* of the frame rails is situated generally at the perimeter boundary of the rectangular area, while a rear lengthwise rail 16*b* is situated inward therefrom to accommodate a rectangular control center box or housing 25 mounted to one of the legs on a rear side of the apparatus to house components of a control system of the feeder and spanning a full height of the outer member 22 of this leg 14. The rear rail 16*b* therefore is fixed to each of the widthwise end rails 18 rather than extending directly between the legs at the rear side of the apparatus. The tag stacking section 100 extends in the lengthwise dimension of the frame between opposed pairs of the legs 14. The tag turning and tag spreading sections 300, 500 are mounted to the frame 12 at a discharge end of the tag stacking section 100.

Tag Stacking Section—Structure

Figure 3:
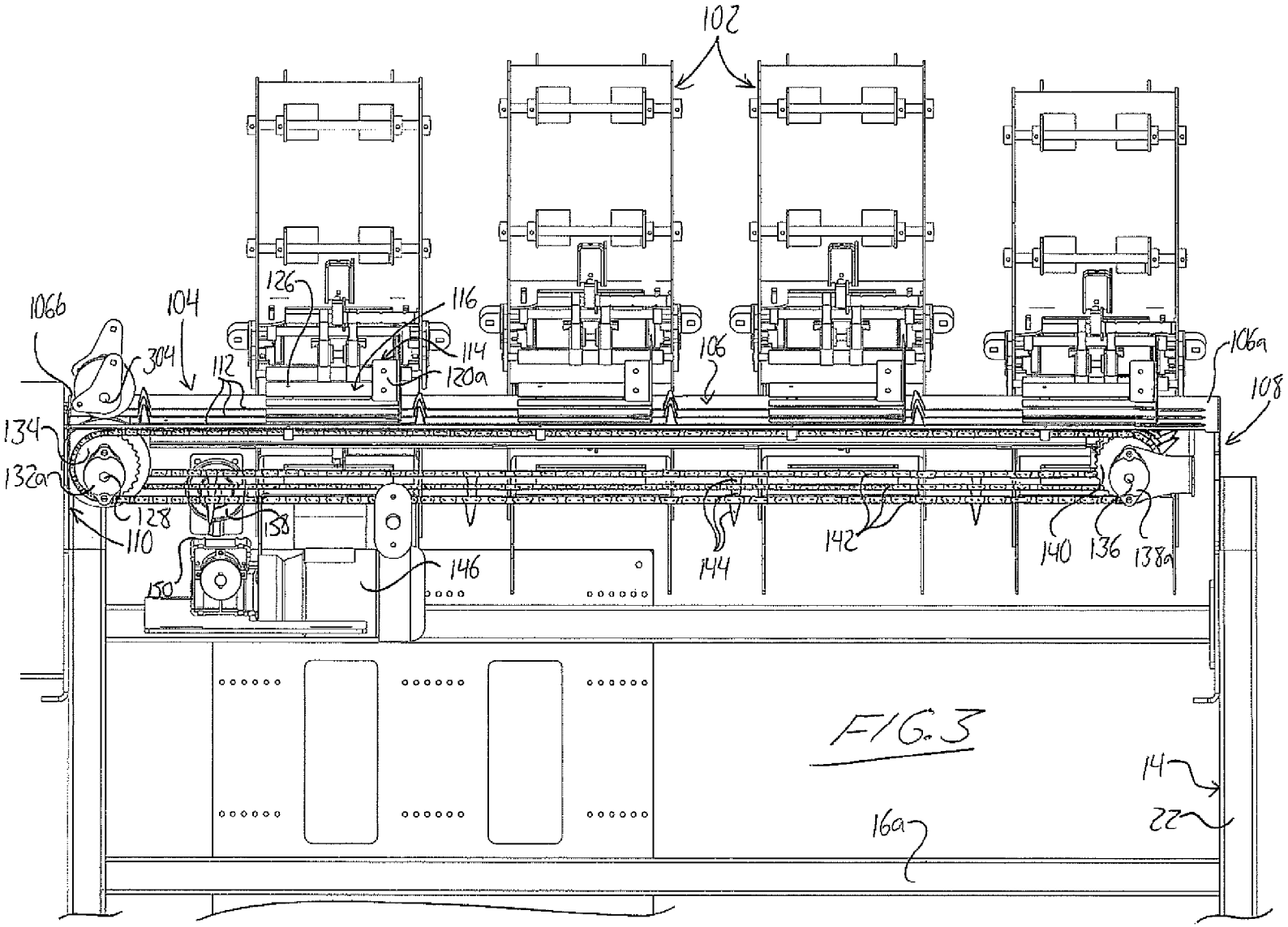
FIG. 3 is a side elevational view of a tag stacking section of the tag feeding apparatus with side wall panels thereof omitted to illustrate installation of conveyor chains of the apparatus.

FIG. 3 shows a front side elevational view of the tag stacking section 100 with a front side panel thereof removed for illustrative purposes. Each of the tag dispensers 102, of which there are four in the illustrated embodiments, is positioned on the rear side of the conveyor assembly to discharge tags one at a time forwardly along the widthwise dimension of the apparatus frame to the conveyor assembly 104. The conveyor assembly 104 features a stationary conveyance plate 106 extending the lengthwise dimension of the apparatus frame 12 from starting end 108 of the tag stacking section 100 to the opposite discharge end 110. Three parallel slots 112 of equal length are provided in the conveyance plate and extend along this lengthwise direction from near the a start end 106*a* of the conveyance plate at the starting end 108 of the tag stacking section 100 to fully reach an opposing discharge end 106*b* of the conveyance plate 106. The tag dispensers 102 are spaced apart along the conveyance plate 106 from a first tag dispenser 102*a* positioned along the slots 110 a short distance from the closed ends thereof adjacent the starting end 106*a* of the conveyance plate 106 to a last tag dispenser 102*z* positioned nearest, but spaced along the conveyance plate 106 from, the discharge end 106*b* of the conveyance plate.

Spaced above and parallel to the conveyance plate 106 at a position directly in front of each tag dispenser 102 is a respective tag tray 114. Each tag tray features a slotted bottom 116 divided into four sections by three lengthwise tray slots 118 that are each parallel to and aligned with a respective one of the slots 112 in the conveyance plate 106 so that a respective plane passing normally through the conveyance plate passes through the aligned conveyance plate slot and tray slot. The tray bottom 116 is carried by a right angle bracket portion 120 of a plate-like structure bent to define a shorter and a longer leg 120*a*, 120*b* diverging from one another at ninety degrees. The shorter leg 120*a* of the tray's bracket portion 120 is fixed face-to-face with a projecting portion 122 of a planar front side wall 124 of the conveyor assembly 104. The front side wall 124 extends the lengthwise dimension of the conveyor assembly 104 and the projecting portion 122 is situated above the conveyance plate 106 and projects upward past the tray bottom 116. The longer leg 120*b* of the tray's bracket portion 120 projects normally from the planar front wall 124 direction perpendicularly across the conveyance plate slots 112 beneath the leg to a side of the slots opposite the front wall 124. Each of the four sections of the tray bottom 116 is also defined by a plate structure bent into an L-shaped form, each having a shorter leg depending perpendicularly downward form the longer leg 120*b* of the bracket portion 18 toward the conveyance plate 106 and a longer leg projecting perpendicularly from the bottom of the shorter leg along the conveyance plate 106 toward the discharge end 106*b* thereof. In the illustrated embodiments, the section of the tray bottom 116 nearest the respective tag dispenser 102 is integral with the bracket portion 120, being part of the same bent plate. The spacing apart of the L-shaped components defining the three tray bottom sections from one another defines the tray slots 118 therebetween. In addition to support on the front wall 124 by the shorter leg 120*a* of the bracket 120, each tray 114 may be further supported by one or more spacers or risers 125 (FIG. 4) mounted between a respective section of the tray bottom 116 and the respective section of the similarly slot-divided conveyance plate 106 therebeneath. With reference to FIG. 1, the embodiment illustrated therein features two such spacers for each tray at the tray bottom section nearest the respective tag dispenser 102, as reflected by fasteners 126 interconnecting the spacers with the tray 114 and the conveyance plate.

Figure 4:
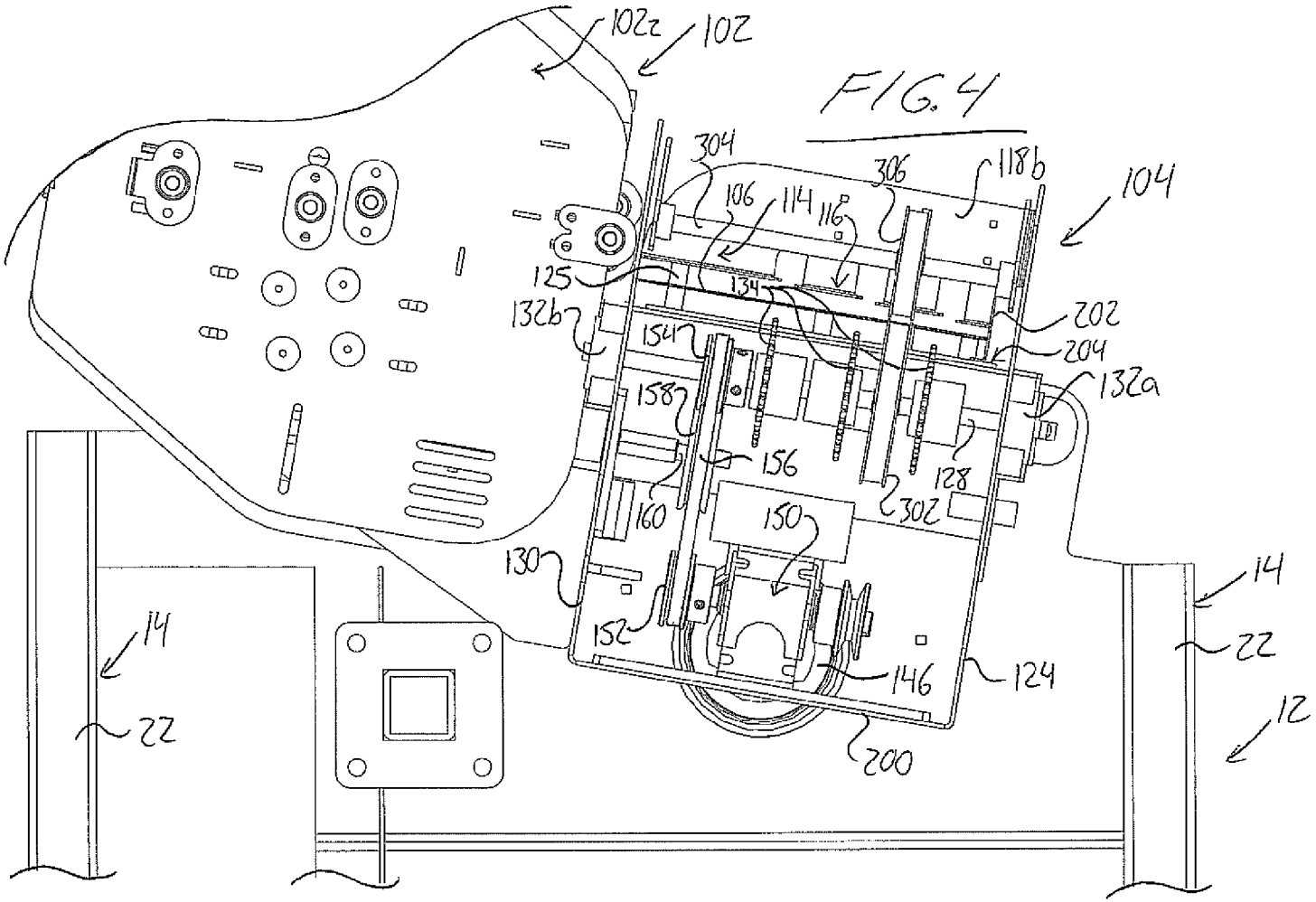
FIG. 4 is an end elevational view of the tag stacking section of from a discharge end thereof with end wail panels and the conveyor chains omitted to illustrate drive train components mounted within the tag stacking section.

With reference to FIGS. 3 and 4, a driven shaft 128 of the conveyor assembly 104 is rotatably carried on the front and rear walls 124, 130 of the conveyor assembly by bearing mounts 132*a*, 132*b* mounted externally thereon, the driven shaft 128 passing through the front and rear walls 124, 130 in a direction normal thereto in order to perpendicularly cross the conveyance plate slots 112 below the conveyance plate 106 adjacent the discharge end 106*b* thereof. The driven shaft 128 has three drive sprockets 134 fixed thereto and spaced apart along the driven shaft 128 by distances corresponding to the spacing between the conveyance plate slots 112 so as to each rotate with the driven shaft 128 in a position adjacent the plane passing through a respective one of the conveyance plate slots 112 and the respective tray slot aligned therewith. An idler shaft 136 is mounted parallel to the driven shaft 128 in the same manner at an equal distance below the conveyance plate 106 at a position in front of the first tag dispenser 102*a* by a respective pair of bearing mounts 138*a*, 138*b* mounted on external faces of the front and rear walls 124, 130 of the conveyor assembly 104. The idler shaft 136 has three idler sprockets 140 fixed thereto, each mounted for rotation with the idler shaft 136 in the same plane as a respective one of the drive sprockets 134 proximate the opposite discharge 110 end of the conveyor section 100.

With reference to FIG. 3, three endless conveyor chains 142 are entrained about the drive and idler sprockets, each chain being entrained about one drive sprocket 134 and the respective idler sprocket 140 in the same plane thereas. Each chain 142 carries a plurality of lugs 144 carried thereon at spaced locations therealong. Each lug 144 projects outward from the endless chain 142 to which it is fixed. The projecting length of the lugs and the distance from the conveyance plate at which the sprockets are positioned are such that each chain moving below the conveyance plate 106 adjacent a respective one of the conveyance plate slots 112 remains below the conveyance plate at all times, while the lugs 144 project upward through the conveyance plate slots 112 and aligned tray slots 118 during the upper portion of the chains' travel between the opposed sprocket sets. The equal spacing between any two adjacent lugs on the same chain corresponds to the equal spacing between any two adjacent tag dispensers along the conveyance plate 106. Each lug 144 on each chain 142 aligns with a respective lug on each of the other two chains. The driven shaft 134 is driven for rotation in such a direction that the chains are pulled from the idler sprockets 140 toward the drive sprockets 134 on the top half of the chains' path nearest the conveyance plate 106. The chains move at the same speed under the equal rotational velocity of the three drive sprockets 134 fixed to the same driven shaft 128. On set of three aligned lugs 144 projecting upward through the conveyance plate and tray slots 112, 118 will reach a tray 114 in front of one tag dispenser 102 just as three other set of three aligned lugs 144 will reach respective trays of the three other tag dispensers.

Figure 14:
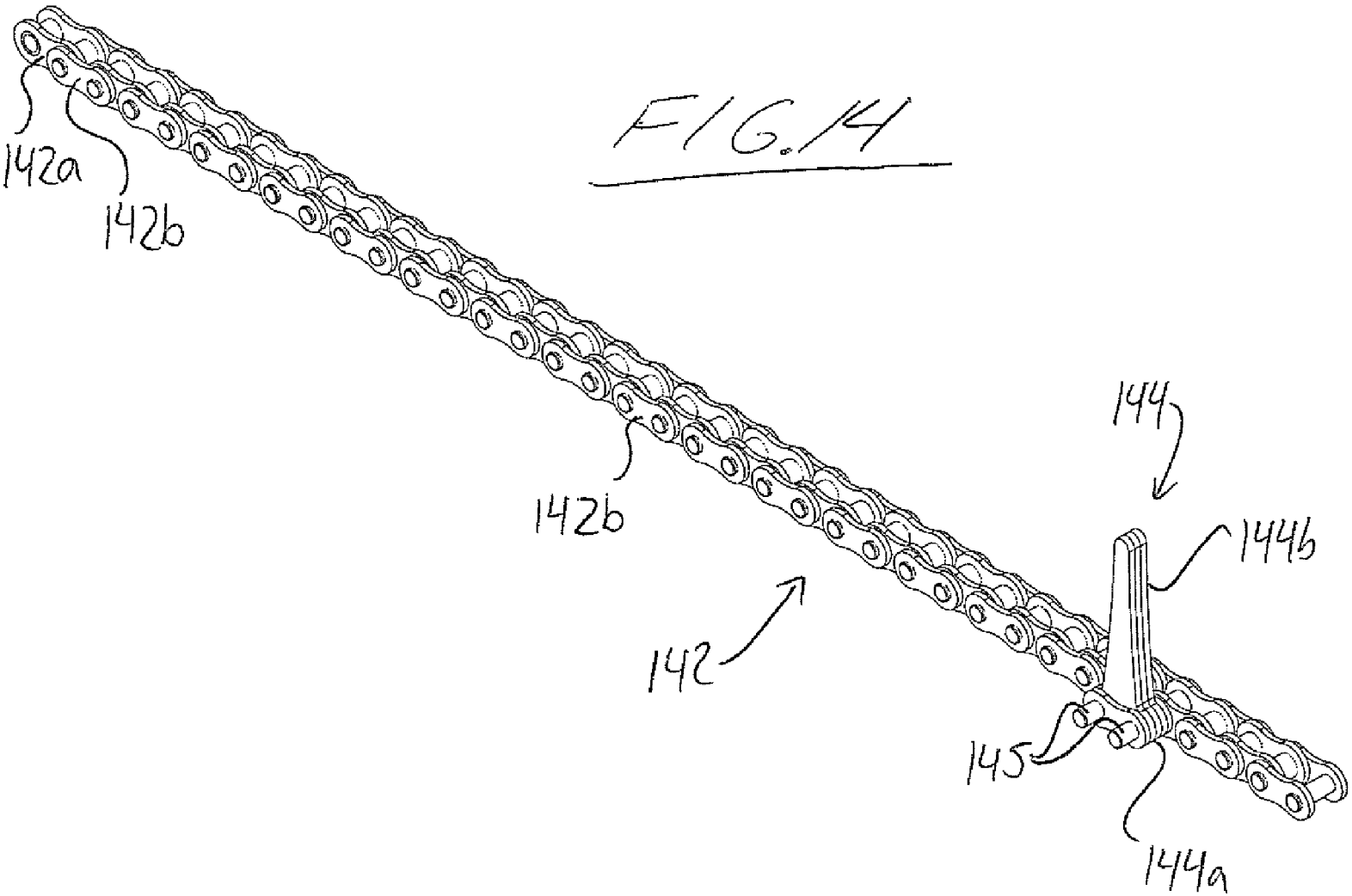
FIG. 14 is an isometric view of a section of one of the conveyor chains used in the tag stacking section of the apparatus.

FIG. 14 shows a section of one of the conveyor chains 42 having a single lug 44 mounted thereon. The chain features inside and outside link pairs 142*a*, 142*b* arranged in a conventional alternating fashion along the length of the chain and interconnected in a known manner using pins passing through aligned apertures in the inside link pair and outside link pair. The lug 144 is fastened to the outer face of an outside link 142*b* using longer pins 145 than at lug-free link pairs to not only pass through apertures of the outside link pair in question and the two neighbouring inside link pairs, but also pass through a pair of apertures extending through a base 144*a* of the lug 144 in order to clamp the lug base 144*a* face-to-face against the respective outside link of the chain. As shown, the lug base 144*a* may have the same peripheral shape as the chain link to which it is engaged, and the lug 144 may be formed of a series of flat plates secured face-to-face against one another and having a common link-shaped base portion and finger-like projecting portion extending perpendicularly from an axis passing diametrically through the apertures in the base portion. As shown, an additional link plate may be placed against the outermost lug plate opposite the chain. The illustrated lug installation positions the lug adjacent the chain so as not to interfere with engagement of the sprocket teeth with the chain.

Figure 5:
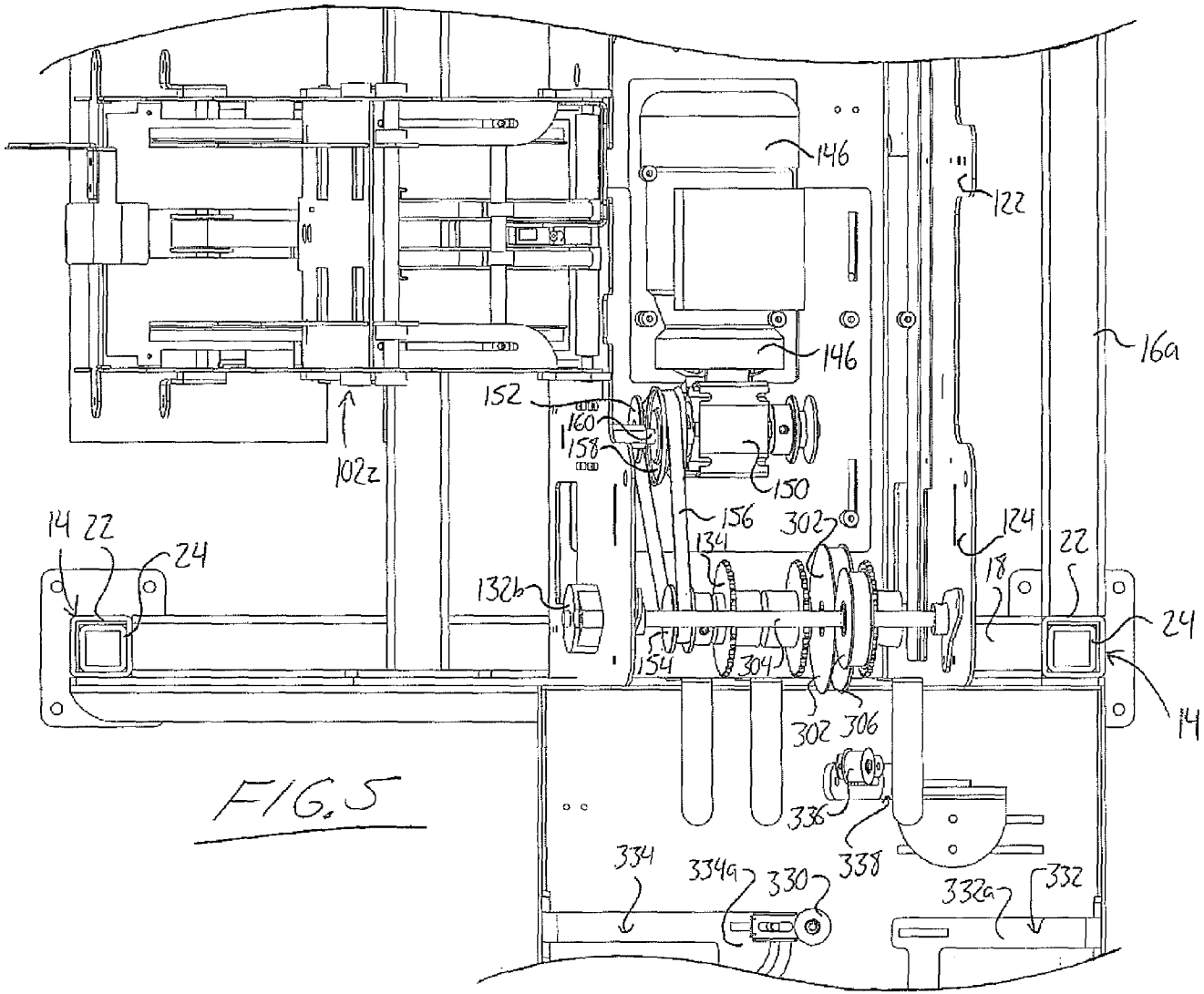
FIG. 5 is an overhead plan view of the discharge end of the tag stacking section with cover panels thereof omitted to again illustrate the drive train components mounted within the tag stacking section.

With reference to FIGS. 3 to 5, an electric motor 146 is carried on to the frame 12 of the apparatus at a position between the front and rear walls 124, 130 of the conveying assembly 104 below the last tag dispenser 102*z* between and below the opposing drive and idler sprocket sets 134, 140. A driveshaft of the motor 146 extends in the lengthwise direction parallel to the conveying plate 106 and the slots therein 118 toward the discharge end 106*b* of the conveying plate 106. The driveshaft extends into a gearbox 148 to drive rotation of two coaxial output shafts of the gearbox which are perpendicular to motor driveshaft and parallel to the driven shaft 128. To one of these gearbox output shafts extending toward the rear wall 130 of the conveying assembly 104 is fixed a motor-driven conveyor drive pulley 152. A corresponding belt-driven conveyor drive pulley 154 is fixed to the driven shaft 128 on which the conveyor drive sockets 134 are mounted. An endless conveyor drive belt 156 is entrained about the motor and belt-driven conveyor drive pulleys 152, 154 and a tensioning conveyor drive pulley 158 mounted for free rotation on a tensioner support shaft 160 mounted on the conveyor assembly's rear wall 130 at an inner face thereof. These conveyor drive pulleys all rotate in a common plane perpendicular to the conveyance plate 106 and parallel to the slots 112 therein. The motor 146 and gearbox 150 are arranged to drive the conveyor drive belt 156 in the direction appropriate to drive the conveyor chains 142 as described above.

Figure 10:
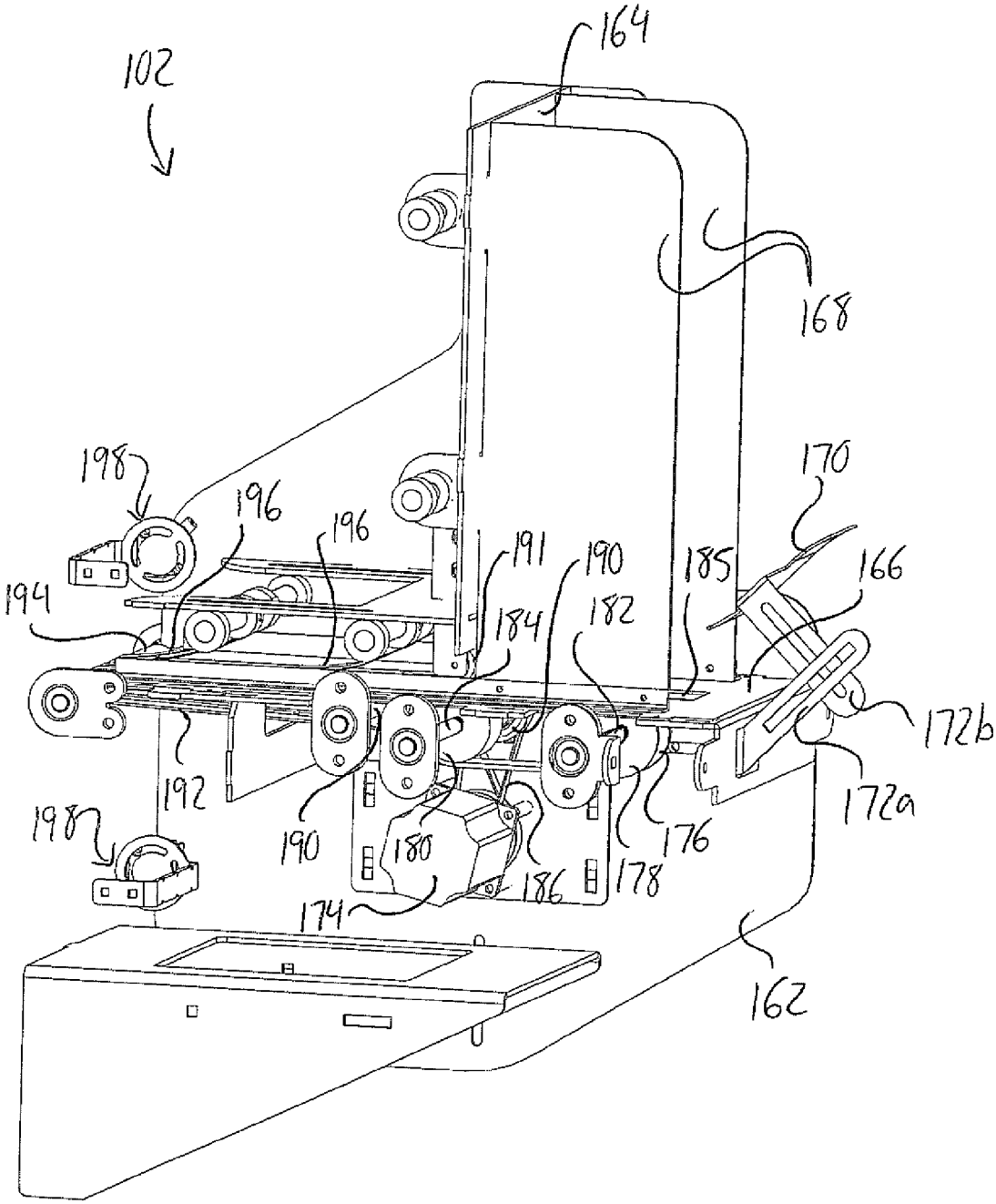
FIG. 10 is a rear side isometric view of a tag dispenser of the tag stacking section of the apparatus with a side wall panel of the tag dispenser omitted for illustrative purposes.
Figure 11:
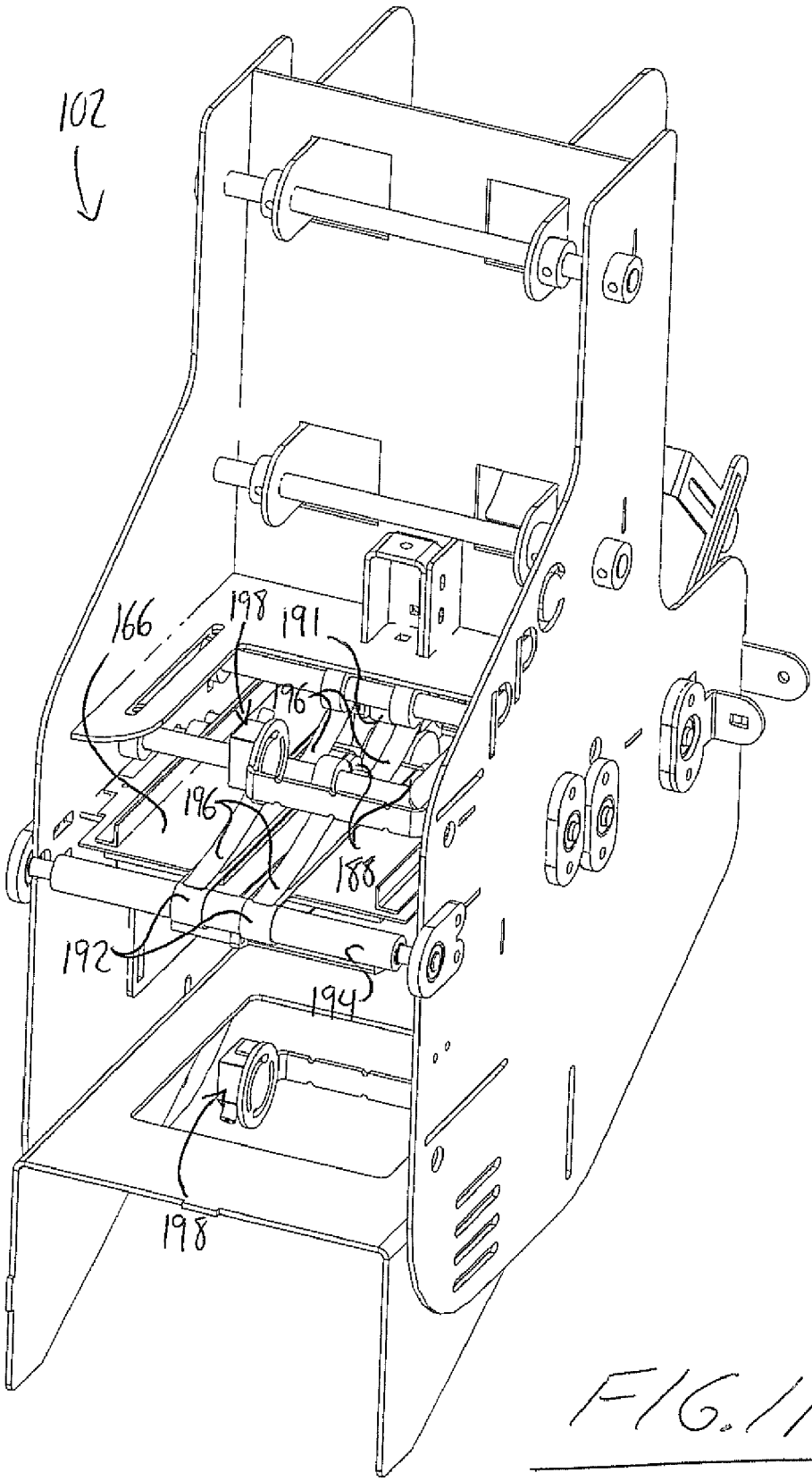
FIG. 11 is a front side isometric view of the tag dispenser of FIG. 10 with the side wall panel thereof in place.

FIGS. 10 and 11 show one of the tag dispensers 102 of the apparatus 10. The dispenser 102 features two parallel outer side wails 162 lying in vertical planes perpendicularly traversing the conveyor and separated by an upright divider wall 164 facing the front of the apparatus and a dispensing plate 166 lying beneath the divider wall 164 in a plane perpendicular thereto. Behind the divider wall 164, a pair of generally rectangular inner side walls 168 project perpendicularly rearward therefrom in planes parallel but spaced inward from the outer side walls 162, extending down past the bottom of the divider wall 164 to the dispensing plate 166. At a rear of the dispenser behind the divider and inner side walls is a support plate 170 situated above the dispensing plate 166 to extend obliquely upward and rearward from a lower end situated over the dispensing plate to an upper end a short distance rearward therefrom. A stack of identical tags is to be placed upon the support plate 170 to depend downward therefrom to seat a lower edge of the stack atop the dispensing plate 166 between the inner side walls 168 behind the divider wall 164. As shown, the support plate 170 may be made adjustable in position and angle relative to the dispensing plate 166 using a stationary arm 172*a* fixed to the dispensing plate and an adjustable arm 172*b* slidable, pivotal and releasably lockable to stationary arm. The illustrated arms are elongate plate members each having a slot therethrough extending its lengthwise direction so that a threaded fastener arrangement can be passed through aligned portions of the two slots and tightened to lock the arms in a desirable fixed configuration.

Below the dispensing plate 166, an electric dispenser motor 174 is mounted to one of the outer side walls 162 with its driveshaft horizontally oriented normal to the vertical plane thereof. An endless withdrawal belt 176 is entrained about first and second withdrawal pulleys 178, 180 fixed respectively to first and second withdrawal shafts 182, 184 parallel to the motor driveshaft and respectively positioned rearward and forward of the divider wall 164 at elevations below the dispensing plate 166. The withdrawal belt 176 travels along the top surface of the dispensing plate 160 through a slot 185 defined therein that extends from proximate the plate's rear end to its front end on the opposite side of the divider wall, moving in a forward direction during the upper portion of the belt's travel so as to frictionally engage a single bottommost tag from the stack leaning against the support plate 170 and withdraw it from the bottom of the stack, pulling it forward along the dispensing plate 166 to pass below the divider wall 164. The motion of the withdrawal belt 176 is driven by rotation of the second withdrawal shaft 184 by a withdrawal drive belt 186 entrained about a motor-driven withdrawal pulley fixed on the driveshaft of the dispenser motor 174 and a belt-driven withdrawal pulley 190 fixed to the second withdrawal shaft 184. A roller 191 rotatably carried on the divider wall 164 immediately forward thereabove it situated directly over the second withdrawal pulley 180 in close proximity thereto to pinch the single bottommost tag of the stack between the roller and pulley to ensure only the single tag is fully withdrawn from the stack and delivered further onward past the divider wall 164.

Just forward of the second withdrawal shaft and pulley 184, 180 is a pair of dispensing pulleys 188 fixed on a first dispensing shaft 190 that is parallel to the withdrawal shafts 182, 184 and situated below the dispensing plate 166. The dispensing pulleys are spaced apart a short distance along the dispensing shaft 190 and a pair of endless belts 192 are entrained about the dispensing pulleys 188 and a dispensing roller 194 situated at the front end of the dispenser 102 just past the front end of the dispensing plate 106 and oriented parallel to the pulley-carrying shafts of the dispenser. The dispensing belts 192 travel along the top surface of the dispensing plate 166 in the slot 185 toward the front end of the dispenser 102 to frictionally engage the single tag pulled forth just past the divider wall 144 by withdrawal belt and continue pulling the tag forward to shoot it out from the front end of the dispenser onto the respective tray 114 of the conveying assembly 104. Resilient spring members 196 situated directly over the dispensing belts 192 at spaced positions therealong bias downward thereagainst to keep the tag in firm frictional engagement therewith. A tag detection sensor 198 is provided proximate the front end of the dispenser 102 and features transmitter and receiver units carried by one of the side walls 162 of the dispenser 102 in alignment with one another above and below the dispensing plate 166 so as to communicate through the slot 185 in the dispensing plate 166 near the front edge thereof between the dispensing belts 192 and detect the presence of a tag by monitoring for interruption of the signal passing between them, which confirms the presence of a tag. Failure to detect a tag during a time interval when one should be present at this location can be used to stop the apparatus and provide an alarm signal to the machine's owner, operator or monitoring personnel.

Referring back to FIG. 4, the front and rear walls 124, 130 of the illustrated conveyor assembly 104 are parallel and interconnected by an integral bottom wall 200 perpendicular thereto, giving the conveying assembly a generally rectangular cross-section bound on three sides by a U-shaped channel defined by these walls. However, the conveying assembly 104 is not supported horizontally, but instead has the planar front and rear walls 124, 130 tilted out of vertical by an oblique acute angle, preferably between 30 and 60 degrees. As the conveyance plate 106 of the illustrated embodiments is perpendicular to the front and rear side walls 124, 130, it is therefore tilted out of horizontal by this same angle so that the conveyance plate 106 slopes downwardly away from the dispensers 102 toward the front wall 124 along the plate's widthwise dimension. In the illustrated embodiments, each dispenser 102 is mounted in an orientation to position its dispensing plate 166 parallel to the conveyance plate 106 at a position thereabove just rearward of the rear wall 130 of the conveyor assembly, and so the conveyance plate has the same downward slope moving from its rear end toward its front end positioned adjacent and slightly above the respective tray 114. Each of the four sections of the tray bottom 116 is parallel to the respective section of the conveyance tray over which it lies, with additional overall sloping of the tray bottom toward downward toward the front wall 124 being contributed by positioning the tray bottom sections increasingly closer to the conveyance plate 106 below moving toward the front wall 124.

As a result of these angles and slopes, each tag dispensed onto one of the trays will slide toward the front wall 124 of the conveyor assembly 104 to position an edge of the tag, i.e. a leading edge of the tag during its dispensing onto the tray from the dispenser, against a guide wall 202 that is fixed to a pair of mounting plates 204 mounted beneath and parallel to the conveyance plate 106 between the drive and idle sprockets sets 134, 140 to extend the length of the conveyance plate 106. The guide wall projects perpendicularly upward from a top one of the mounting plates 204 supported between the side walls 124, 130 along an edge of this support plate adjacent the front wall 124 so as to be parallel to the front side wall 124 and project upward past and flush with the edges of the conveyance plates 106 and tray bottoms 116 opposite the dispensers. The slope also encourages this edge of the tag to remain against the guide wall 202 during subsequently movement of the tag down onto the conveyance plate or onto another tag already so displaced downward onto the conveyance plate, for stacking of the tags as described herein further below.

Tag Stacking Section—Operation

Each dispenser 102 is supplied with a source stack of tags by placing the stack against the support plate 170 at the provided tag source area behind the divider wall 164. Each stack contains identical tags, but the tags of each stack are different that than the tags stacked at another of the dispensers 102. After this initial stocking of the tags, an initialization sequence is carried out as follows. First, the electric motor 146 of the conveyor assembly 104 is activated to drive the conveyor chains 142 to position each aligned set of three lugs 144 just behind each tray of the four dispensers as shown in FIG. 3. Next, with the lugs 144 so positioned, the first dispenser 102*a* has its motor driven momentarily to dispense a single card from its source onto its respective tray above the conveyance plate 106 of the conveyor assembly 104. Then the electric motor 146 of the conveyor assembly 104 is activated to drive the conveyor chains 142 to index each aligned set of three lugs 144 from its current position forward by the fixed distance corresponding to the spacing along the chain between adjacent sets of aligned lugs, which matches the spacing between the dispensers along the conveyance plate 106. The moves the set of lugs originally positioned just behind the tray of the first dispenser 102*a* forward past the first dispenser to their new position just behind the tray of the second dispenser, thus pushing the single dispensed tag from atop the first tray off the edge of this tray nearest the discharge end 110 of the tag stacking section 100, where the tag falls onto the conveyance plate 106 below the tray, and further pushing the tag onward to a position beneath the second tray. Next, a single tag is dispensed by each of the first two dispensers, and the conveyance chains are then indexed forward another single step. This brings the tag from the first tray forward to beneath the second tray, just as before for the very first dispensed tag, and pushes the tag from the second dispenser tray to fall down onto the first tag previously positioned therebeneath as these two tags are simultaneously propelled forward toward the third tray. With the first tag from the second dispenser so stacked atop the first tag from the first dispenser, this two-tag stack is pushed forward to beneath the third tray by completion of this second indexing of the conveyor chains 142. Next, a single tag is dispensed from each of the first, second and third dispensers and the conveyance chains are then indexed forward another single step. This again brings a tag from the tray of the first dispenser to beneath the second dispenser tray, again stacks two different tags atop one another as they pass the end of the second dispenser tray and brings them to the third dispenser, and additionally stacks the first tag dispensed by the third dispenser atop the two tags previously stacked at the second dispenser and brings these three tags to a position beneath the tray of the fourth dispenser 102*z*. To finish the initialization sequence, a final step dispenses a single tag from each of the four dispensers and the conveyance chains are then indexed forward another single step. This again brings a tag from the tray of the first dispenser to beneath the second dispenser tray, again stacks two different tags atop one another as they pass the end of the second dispenser tray and brings them to the third dispenser, again stacks three different tags atop one another as they pass the end of the third dispenser tray and brings them to the fourth dispenser, and additionally stacks the first tag dispensed by the fourth dispenser atop the three tags previously stacked at the third dispenser and brings these four tags to a position adjacent the discharge end of the conveyance plate.

The initialization procedure may be summarized as: step 1—run the conveyor to position a set of lugs just behind each tray; step 2—dispense a single tag from the first dispenser; step 3—index the conveyor forward a single step; step 4—repeat steps 2 and 3 N−1 times, where N is the number of dispensers spaced along the conveyor, each time in step 2 dispensing a single tag from the next dispenser in the sequence that was not actuated in the immediately preceding execution of step 2. At the end of this initialization sequence, there is a stack of four different tags from the four dispensers sitting atop the conveyance plate proximate the discharge end 106*b* thereof at a location past the fourth dispenser, a stack of three different tags from the first three dispensers sitting atop the conveyance plate 106 below the fourth dispenser tray, a stack of two different tags from the first two dispensers sitting atop the conveyance plate 106 below the third dispenser tray and a single tag from the first dispenser sitting atop the conveyance plate 106 below the second dispenser tray. As an alternative to the initialization sequence, tags can be manually placed beneath the second, third and fourth dispensers in the above described manner.

After the initialization is complete, a repeating sequence is then carried out over and over, in a first step of which all dispensers of the apparatus are each activated to dispense only a single tag onto the respective tray, with the conveying chain being activated in the second step to index each lug set forward one position along the chain's travel path. This moves the tag above each tray and any tag below the tray (i.e. any and all tags previously indexed forward from any dispenser immediately preceding the dispenser in question) together along the conveyance plate 106 with the tag from atop the tray falling downward onto any such tags below the tray atop the conveyance plate, thus stacking the tags face-to-face one atop the other. This sequence of a tag dispensing step and following chain indexing step is then repeated over and over, each time bringing four tags, each from a respective one of the four different tag sources, from the fourth dispenser to the discharge end of the tag stacking section in a face-to-face vertical stack or pile. In each repetition of this sequence, at each dispenser other than the first dispenser, the tag delivered by the dispenser onto the respective tray is forced off the tray to fall onto the tag dispensed by the preceding dispenser during the immediately preceding dispensing and indexing sequence. The dispensing step therefore adds a single tag to the number of tags beneath its tray. Preferably all dispensers simultaneously distribute their respective individual tags during the dispensing step of the dispensing and indexing sequence.

As described above, an edge of the tag adjacent the front wall 124 of the conveying assembly sits against the guide wall 202 which is perpendicular to the conveying plate 106, so that this particular edge of each of the tags in the stack aligns with this same edge of each other tag in the stack. Similarly, as each tag is engaged by a set of lugs that aligned with one another along the conveying direction, another edge of the tag, considered the trailing edge during conveyance by the lug-equipped conveying chain, will be positioned in general alignment with the same edge of the other tags in the stack. General alignment of these two edges, which are perpendicularly meeting edges in the case of rectangular tags, will provide a significant overall alignment of the tags within the stack when using equally sized tags. Although the tags are subsequently spread apart within their stacked configuration later on, providing general alignment of the tags initially during the stacking process yields generally consistent spreading out of stacks to provide reliable results under operation of the apparatus.

Tag Turning Section—Structure

Figure 6:
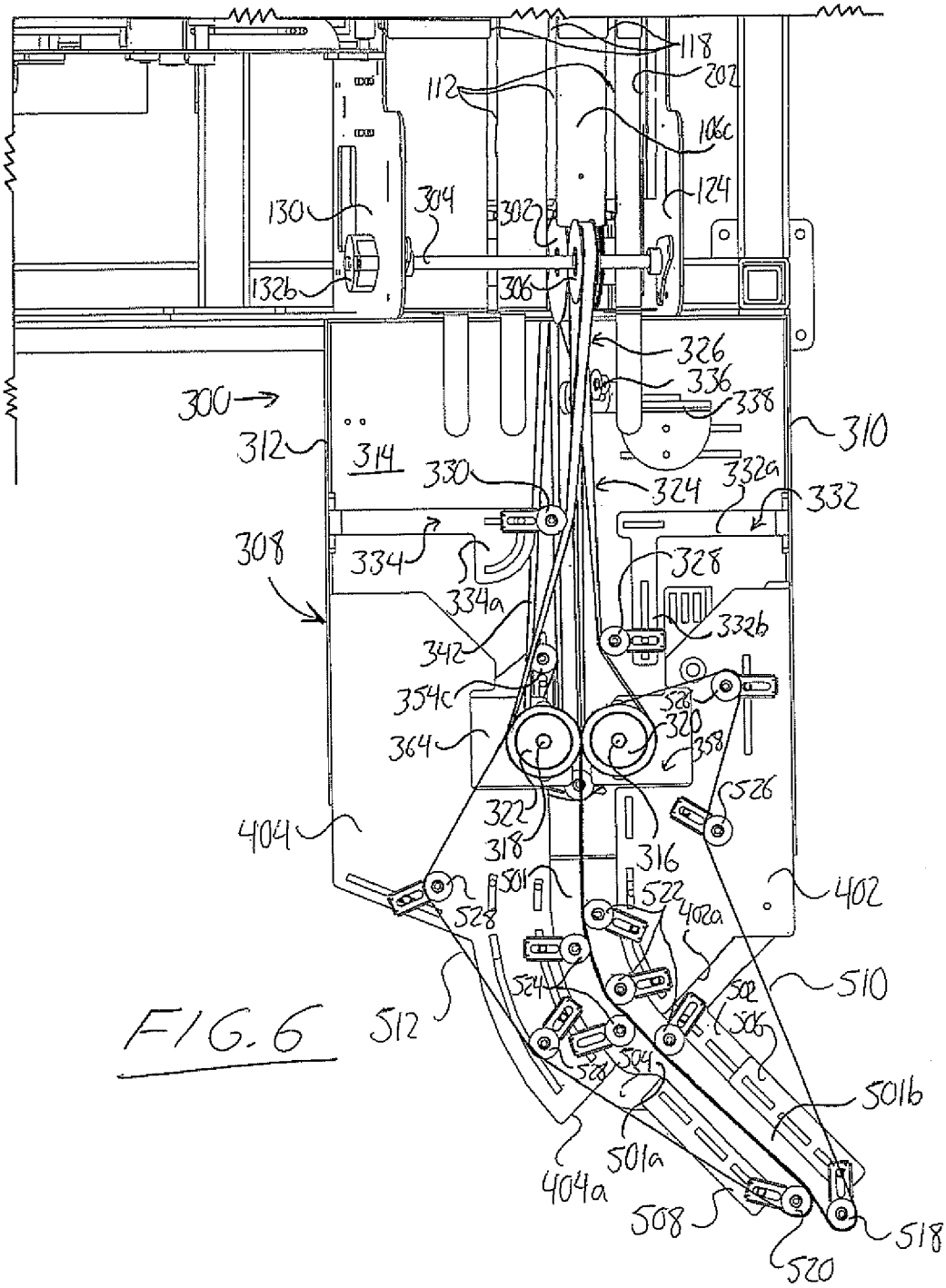
FIG. 6 is an overhead plan view of tag turning and tag spreading sections of the apparatus mounted at the discharge end of the tag stacking section with conveying belts of tag turning and tag spreading sections installed.
Figure 7:
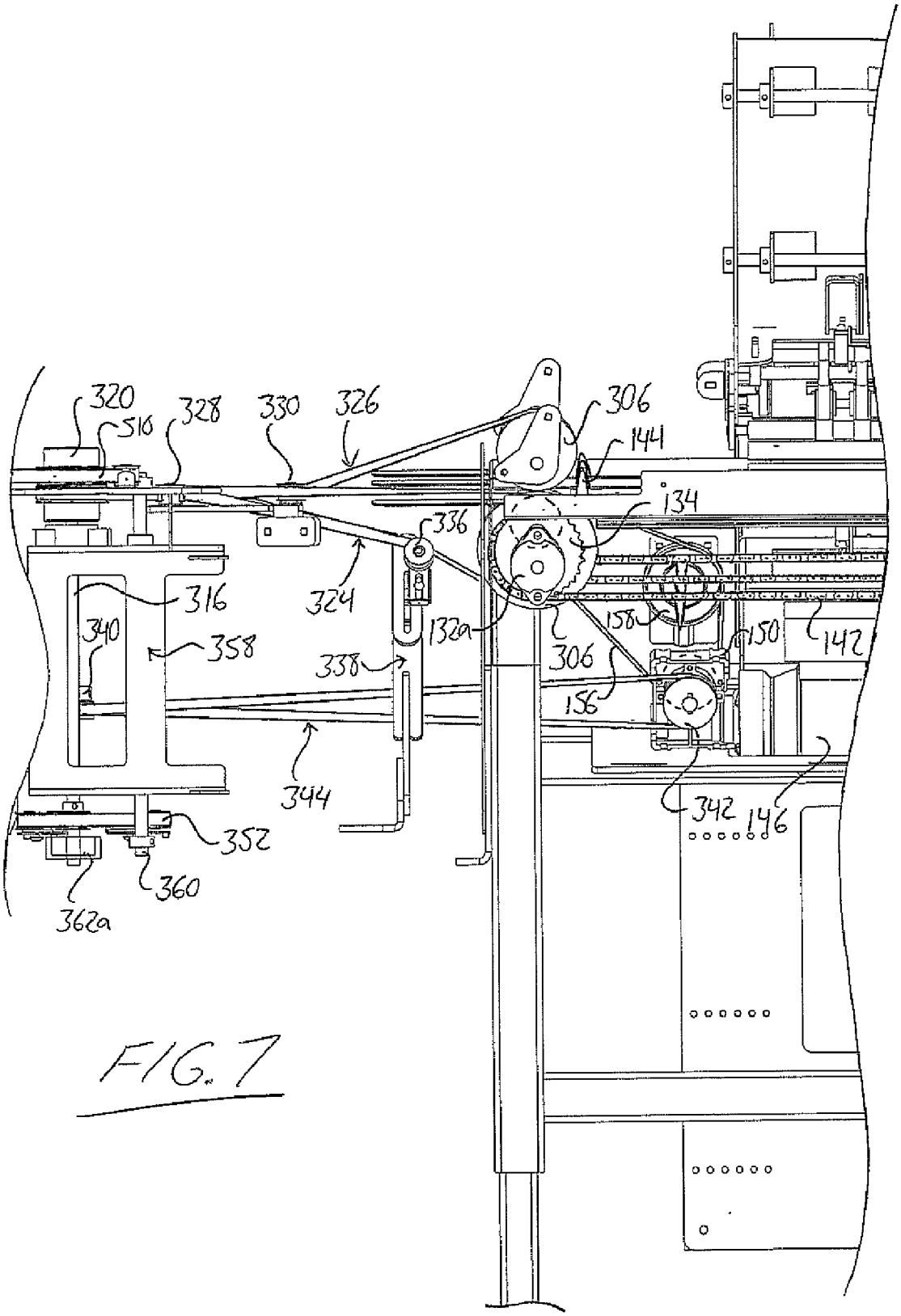
FIG. 7 is a partial side elevational view of the tag stacking, tag turning and tag spreading sections of the apparatus with side wall panels of the sections omitted to illustrate drive train components of these sections.

FIGS. 5 to 7 best illustrate details of the tag turning section 300 of the apparatus 10 where each stack containing a plurality of different tags is received from the above-described tag stacking section 100 and the face-to-face grouping of stacked tags is turned through a predetermined angle from the one-atop-another stacked orientation into a upright orientation in which the tags are preferably vertically oriented, and at least in a more vertical than horizontal orientation.

A first inlet pulley 302 is rotatably mounted on the driven shaft 28 of the conveyor assembly 104 between the two driven sprockets 134 nearest the front wall 124 of the conveyor assembly 104 by a bearing assembly so as to be freely rotatable about the axis of the driven shaft 28. A fixed shaft 304 is mounted at opposite ends to inner faces the front and rear side walls 124, 130 of the conveying section adjacent the discharge end 110 thereof at an elevation above the driven shaft 28 of the conveyor assembly 104, the axis of the fixed shaft 304 being parallel and coplanar with the axis of the driven shaft 28. A second inlet pulley 306 is rotatably mounted on the fixed shaft 306 by a bearing assembly so as to be freely rotatable about the axis of the fixed shaft in the same rotational plane as the first inlet pulley 302.

Figure 8:
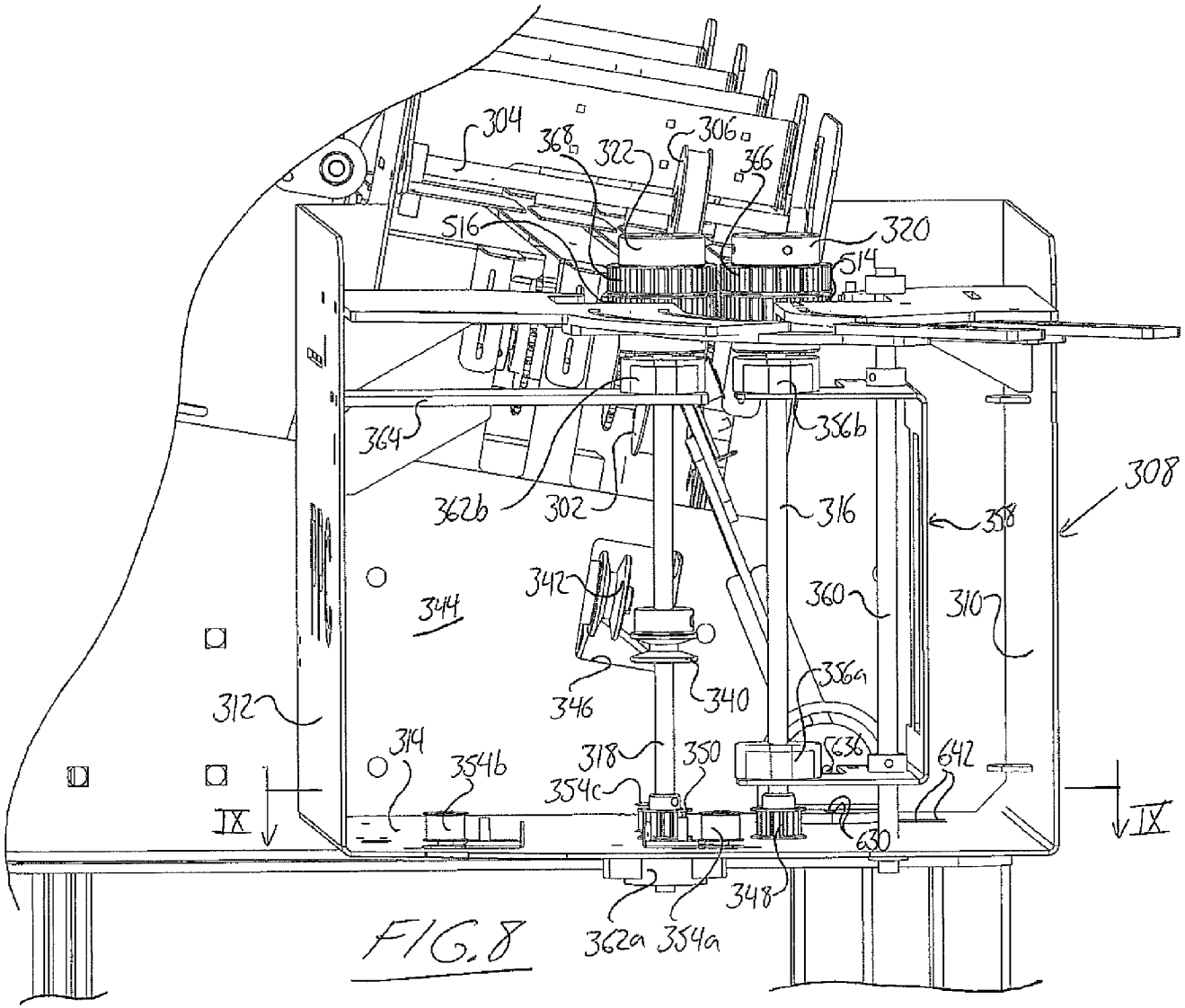
FIG. 8 is a partial end elevational view of the apparatus with an end panel and drive belts of the tag turning and tag spreading sections omitted to better show particular drive train components of the apparatus.

A channel-like housing 308 of a squared-off U-shape in vertical cross-section is fixed to the apparatus frame 12 to project horizontally outward therefrom at the widthwise end thereof opposite the starting end 108 of the tag stacking section 100, thereby continuing along the lengthwise dimension of the frame and apparatus along which the conveying assembly 104 of the tag-turning section 100 extends. This housing 308 features vertically extending front and rear side walls 310, 312 that are positioned outward from the respective non-vertical front and rear side walls 124, 130 of the conveyor assembly 104 and are interconnected at bottom ends by a horizontal bottom wall 314. With reference to FIGS. 6 and 8, first and second rotatable vertical shafts 316, 318 are supported within the housing 308 at a distance from the connection of the housing 308 to the primary frame 12 of the apparatus. First and second transition pulleys 320, 322 are fixed to the rotatable first and second vertical shafts 316, 318 respectively at upper ends thereof so as to be situated in a common horizontal plane at an elevation generally equal to the elevation of the conveyance plate 106 of the tag stacking section 100 at the point across this plate at which the first and second inlet pulleys 302, 306 are situated. The transitions pulleys 320, 322 are equidistant from the discharge end 106*b* of the conveyance plate 106 along the lengthwise direction of the apparatus, with the first transition pulley 320 being positioned nearest the front wall 310 of the housing 308 and the second transition pulley 322 being positioned nearest the rear wall 312 of the housing 308.

As shown in FIGS. 6 and 7, a first twisted endless belt 324 is entrained about the first inlet pulley 302 and the first transition pulley 320, and a second endless belt 326 is entrained about the second inlet pulley 306 and the second transition pulley 322. These belts are twisted through a same angle corresponding to an angle between the tilted non-vertical but upright plane of the inlet pulleys 302, 306 and the horizontal plane of the transition pulleys 320, 322. The portion of the first twisted belt 324 wrapping about the first inlet pulley 302 from thereunder wraps about the first transition pulley 320 from the side thereof nearest the front wall 310 of the housing 308, and the portion of the second twisted belt 326 wrapping about the second inlet pulley 302 from thereover wraps about the second transition pulley 320 from the side thereof nearest the rear wall 312 of the housing 308. The remaining portion of the first twisted belt 324 wrapping over the first or bottom one of the inlet pulleys 302 and the remaining portion of the second twisted belt 326 wrapping under the second or top one of the inlet pulleys 306 thus wrap around the first and second transition pulleys 320, 322 respectively from therebetween. These remaining portions of the twisted belts may be referred to as inner portions or sections as they extend between the inlet pulleys and between the transition pulleys, in other words on the inside of the inlet pulley pair and the transition pulley pair.

At each of the inlet pulley pair 302, 306 and the transition pulley pair 320, 322, the pulleys are positioned in close proximity to one another so that outer faces of two twisted belts 322, 324 (i.e. the face or surface of the belt that faces outwardly away from the pulley as it wraps therearound) are in contact or very close proximity to one another along the inner sections of the two twisted belts 322, 324 from between the inlet pulleys 302, 306 to between the transition pulleys 320, 322. The two inlet pulleys 302, 306 counter-rotate, or rotate in opposite directions to one another, as accordingly do the two transition pulleys 320, 322. As described herein further below, the belts are driven to move at the same speed with the inner sections of the belts moving together from the inlet pulleys 302, 306 to the transition pulleys 320, 322. Face-to-face with one another and moving together between the inlet and transition pulley pairs, the inner sections of the twisted belts 324, 326 twist through the same angle as they move along this path as a result of the different orientation of these two pulley pairs.

With reference to FIG. 6, the inlet pulleys 302, 306 are positioned between the two of the conveyance plate slots 312 nearest the front wall 124 of the conveyor assembly 104, and the elongate section of the conveyance plate 106 defined between these two slots stops short of the discharge end 106*b* of the conveyance plate defined by the co-terminating other sections of the conveyance plate outside these two slots so that this shorter section 106*c* of the conveyance plate 106 terminates at or just short of the inlet pulleys 302, 306 on the side of the coplanar driven and fixed shafts 128, 304 opposite the housing 308. Referring to FIG. 3, when the lugs 144 of the conveying chain 142 bring a stack of tags from the last tag dispenser 102*z* toward the discharge end 106*b* of the conveyance plate 106, the stack is pushed by the lugs 144 to between the inlet pulleys 302, 306 so that the stack of tags is frictionally gripped between the inner sections of the twisted belts 124, 126 arranged face-to-face at or across the plane of the conveyance plate 106 and carried by the twisted belts off the discharge end 106*b* of the conveyance plate.

Figure 15:
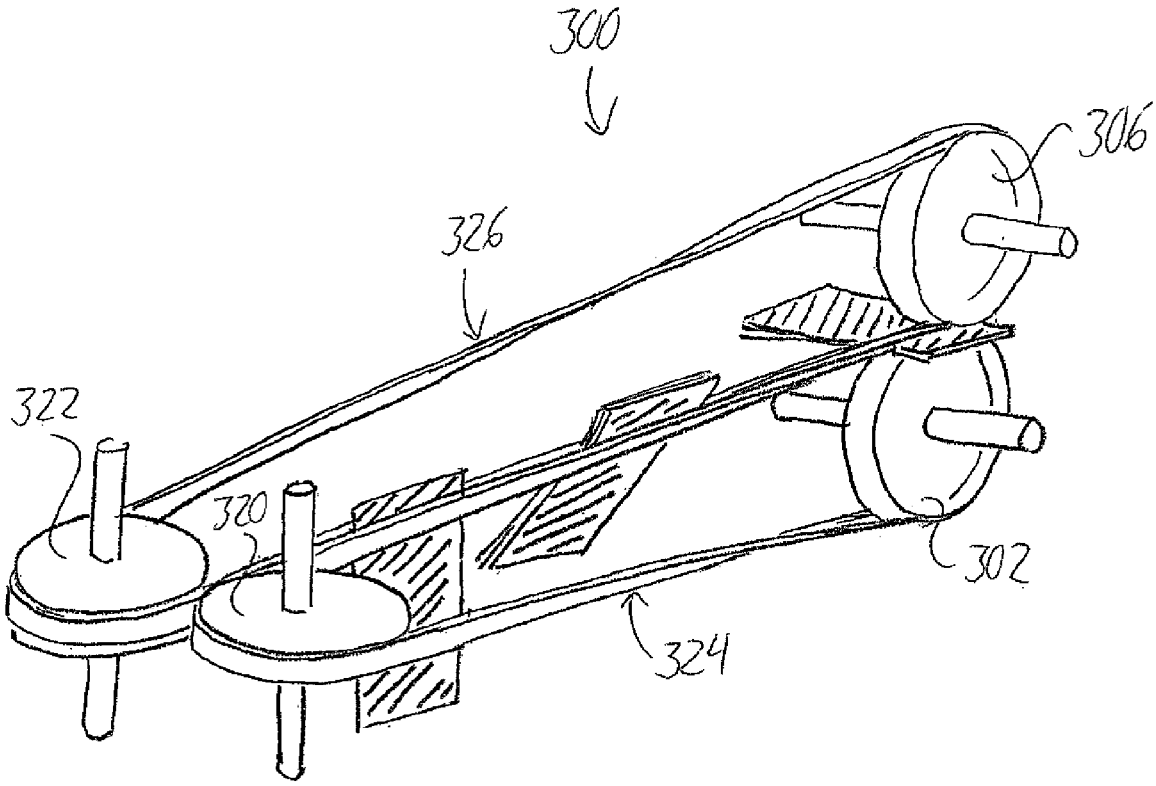
FIG. 15 is a schematic illustration demonstrating the function of the tag turning section of the apparatus.

Due to the twisting of the belts through the predetermined angle from the inlet pulleys 302, 306 to the transition pulleys 320, 322, the tags are turned through the same angle to go from their more horizontal than vertical face-to-face orientation at entry to the tag-turning section 300 at the inlet pulleys 302, 306 to a vertical face-to-face orientation at the transition pulleys. FIG. 15 schematically illustrates operation of the tag-turning section 300, but shows the inlet pulleys 302, 306 in a vertical plane for ease of illustration, and accordingly showing a stack of horizontally oriented tags being turned through ninety degrees into a vertical orientation where the group of tags remain arranged face-to-face, but in a side-by-side grouping rather than one-atop-another stack.

Referring back to FIGS. 6 and 7, two horizontal guide pulleys 328, 330 are mounted for free rotation about vertical axes on horizontal support plate arms 332, 334 projecting inward from the front and rear side wails 310, 312 of the housing 308 to tension or guide the twisted belts by engaging the outer sections of the belts at points between the inlet pulleys 302, 306 and the transition pulleys 320, 322. In the illustrate embodiment, a first horizontal guide pulley 328 engages the outer section of the first twisted belt 324 at a position nearer the first transition pulley 320 than the inlet pulleys and a second horizontal guide pulley 330 engages the outer section of the second twisted belt 324 at a position proximately half way between the inlet and transition pulley pairs. The first horizontal guide pulley 328 has its rotational axis generally in line with the axis of the first transition pulley 320 across the widthwise direction of the apparatus, while the second horizontal guide pulley is slightly closer to the twisted belts' inner sections extending linearly between the inlet and transition pulley pairs in a direction parallel to the lengthwise dimension of the apparatus. The first support arm 332 has a right angle configuration, with a first section 332*a* projecting perpendicularly inward from the front wall 310 of the housing 308 and a second section 332*b* projecting perpendicularly from the first section toward the first transition pulley 332 to support the first horizontal guide pulley 328. The second support arm 334 projects perpendicularly inward from the rear wall 312 of the housing 308 and has a sector or pie-shaped distal end portion 334*a* presenting an arcuate distal edge curving ninety degrees toward the transition pulleys 320 and then the rear wall 312 from a vertical plane perpendicularly crossing through the parallel front and rear walls 310, 312 of the housing 308.

An obliquely mounted guide pulley 336 is mounted for free rotation about a non-vertical axis tilted less than forty-five degrees out of horizontal. The rotational axis of this pulley extends upward moving toward the front wall 310 of the housing 308 and lies in a vertical plane perpendicular thereto, the obliquely mounted pulley 336 engaging the outer section of the first twisted belt between the second horizontal guide pulley 330 and the discharge end 106*b* of the conveyance plate 106 in the lengthwise direction of the apparatus and between the first inlet pulley 302 and the front wall 310 of the housing 308 in the widthwise direction of the apparatus. The obliquely mounted pulley is carried by a sloping support arm 338 mounted to the bottom wall 314 of the housing to slope obliquely upward therefrom.

FIG. 8 illustrates drive components of the tag turning section 330, which also drive the tag spreading section as explained herein further below. A horizontal belt-driven pulley 340 is fixed to the second vertical shaft 318 inside the housing 308 at an elevation generally equal to that of the output shafts of the gearbox 150 of the conveyor assembly.

The second output shaft of the gearbox 50 has a second motor-driven drive pulley 342 fixed thereon on a side of the gearbox 50 opposite the motor-driven conveyor drive pulley 152. A twisted drive belt 344 is entrained about the second motor driven drive pulley 342 and the horizontal belt-driven pulley 340, as best shown in FIG. 7 and also partly visible in FIG. 6. As shown in FIG. 8, the an end panel 344 fixed on the apparatus frame 12 at the end thereof opposite the starting end may be used, in which case an opening or window 346 is provided therein in a position along a straight line path from the second motor driven drive pulley 342 to the horizontal belt-driven pulley 340 to accommodate passage of the twisted drive belt 344 through the end panel 344. Driving of the second motor driven drive pulley 342 by the motor 146 through the gearbox 250 drives the belt in the appropriate direction to drive rotation of the fixed-together second motor driven drive pulley 342 and second vertical shaft 318 in the necessary direction to pull the inner section of the second twisted belt 326 to the second transition pulley 322 on the second vertical shaft 318.

Figure 9:
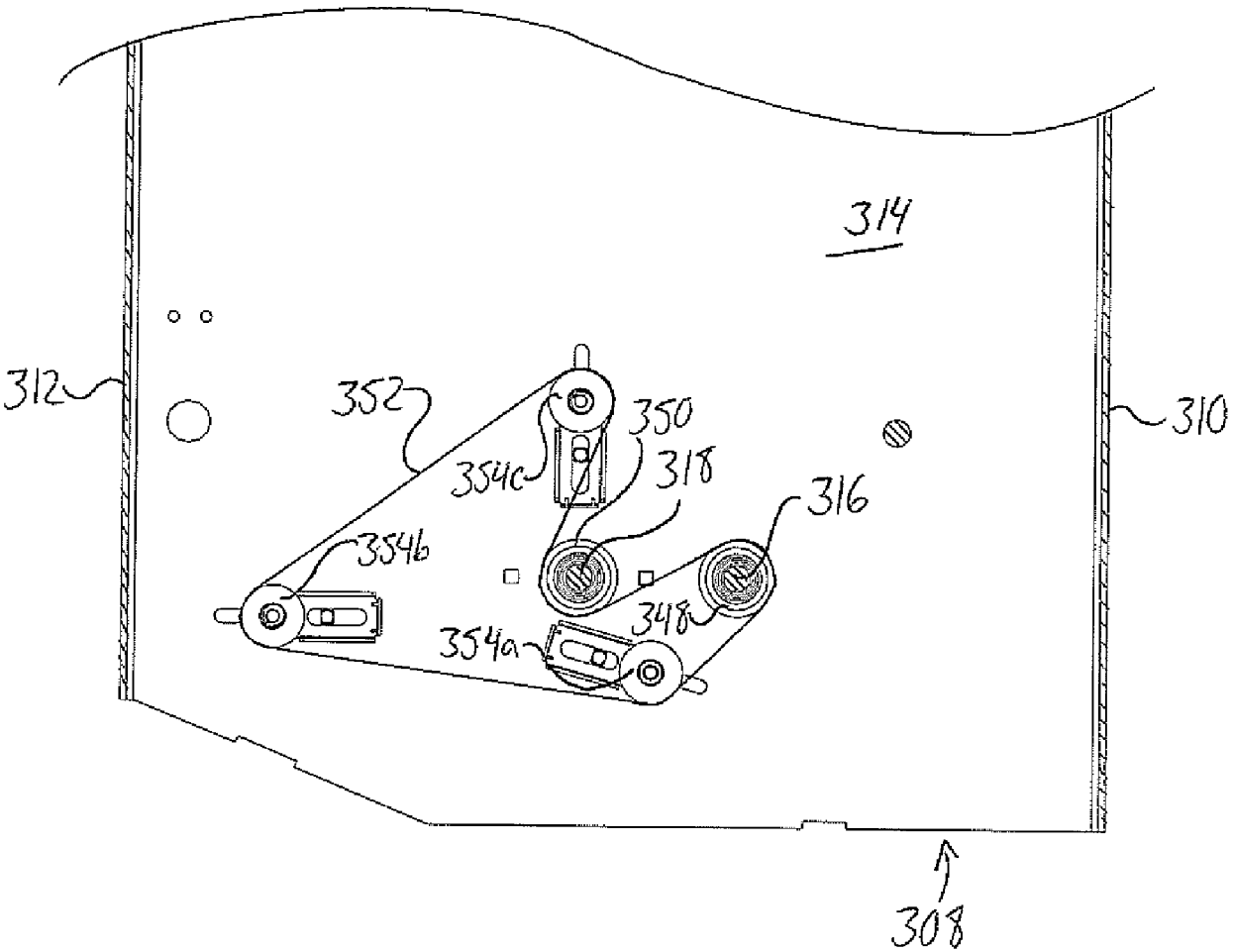
FIG. 9 is a partial cross-sectional view of the tag turning and tag spreading sections of the apparatus as taken along line IX-IX of FIG. 8.

Referring to FIGS. 8 and 9, first and second bottom drive pulleys 348, 350 are fixed to the first and second vertical shafts 316, 318 at or a short distance above the top face of the housing's bottom wall 314 for rotation with these shafts. A double sided belt 352 is entrained around the two bottom drive pulleys 348, 350 and three lower guide pulleys 354*a*, 354*b*, 354*c* mounted atop the bottom wall 314 of the housing at equal elevations with the bottom drive pulleys 348, 350 such that opposite sides of the double sided belt 352 engage with the two bottom drive pulleys 348, 350 so that rotation of the second bottom drive pulley 350 with the second vertical shaft 318 under driven rotation of the horizontal belt-driven pulley 340 thereon drives rotation of the first bottom drive pulley 348 in the opposite direction, thereby providing the counter-rotation of the transition pulleys 320, 322 at the top ends of the vertical shafts 316, 318 necessary to drive the twisted belts 324, 326 of the tag-turning section.

In the illustrated embodiments, the first vertical shaft 316 is rotatably supported by two bearing housings 356*a*, 356*b* mounted on vertically-spaced horizontally-projecting legs of a brace 358 fixed to the housing 308 in a vertical space defined between the bottom wall 314 thereof and the transition pulley pair 320, 322 by a stationary vertical shaft 360 passing through and fixed to the bottom wall 314 of the housing 308 and a horizontal upper plate thereof between the housing's front wall 310 and the first transition pulley 320 at the elevation thereof. The second vertical shaft 318 is rotatably supported by two additional bearing housings 362*a*, 362*b* mounted respectively to a bottom surface of the housing's bottom wall 314 and a top surface of an intermediate horizontal plate 364 projecting perpendicularly from the housing's rear wall 312 at an elevation equal to the top leg of the brace 358.

Tag Turning Section—Operation

As the twisted belts 324, 326 of the tag turning section are driven by the same motor 146 as the chain conveyor 142, operation of the stacking section to stack different and distinct tags atop one another and convey the stacked tags toward the discharge end 106*b* of the conveyor plate also causes each such formed stack of tags to be frictionally gripped between the twisted belts at the inlet pulleys 302, 306 and conveyed onward to the transition pulleys while being turned through the appropriate angle to orient the face-to-face tags vertically to position the tag into adjacent vertical planes between the twisted belts at the transition pulleys. Should the motor be stopped at any time, for example in response to a dispenser running out of source tags in the stacking section and the absence of a dispensed tag being detected by the dispenser's sensor 198, any grouping of tags passing along the twisted belts of the conveyor will automatically stop and be held in place between the belts, ready to continue onward through the system once the problem in the stacking section has been addressed and the motor 146 is reactivated.

Tag Spreading Section—Structure

With reference to FIG. 6, stationary first and second horizontal upper plates 402, 404 project inward from the front and rear side walls 310, 312 of the housing 308 respectively and extend along the side walls 310, 312 from positions between the transition pulley pair 320, 322 and where the horizontal support arms 332, 334 project inward from the side walls 310, 312 to free ends 402*a*, 404*a* situated outwardly past the end of the housing 308 opposite the apparatus frame 12. The upper plates 402, 404 are positioned, shaped and dimensioned to be spaced apart from one another in the cross-wise or width-wise direction of the apparatus, thereby leaving space to accommodate the transition pulleys 320, 322 and the twisted belts wrapped thereabout between them. Moving past the transition pulleys 320, 322 away from the tag stacking section 100 along the lengthwise longitudinal direction of the apparatus, the upper plates 402, 404 remain spaced apart, here being spaced apart by a gap 501 of generally uniform width between the coplanar upper plates 402, 404, the gap initially extending linearly away from the transition pulleys 320, 322 past a distal end 308*a* of the housing 308 opposite the apparatus frame 12 with a central axis of the linear portion of the gap in the same vertical plane as the linear path followed by the inner sections of the twisted belts 324, 326 of the tag turning section 300. Past the distal end 308*b* of the housing 308, the gap 501 between the upper plates 402, 404 deviates from this vertical plane, curving to the same side thereof as the front wall 312 of the housing 308. Adjacent the gap 501 on opposite sides thereof, the upper plates 402, 404 end at a vertical plane orientated at approximately forty-five degrees to the vertical plane of the housing's front wall 310.

In the illustrated embodiments, the tag-spreading section 500 features first and second extension plates 502, 504 connected to the first and second upper plates 402, 404 between the free ends 402*a*, 404*a* thereof and the distal end 308*a* of the housing 308. The first and second extension plates 502, 504 lie face-to-face against the first and second upper plates 402, 404, specifically against the bottom faces thereof in the illustrated embodiments, and project outward therefrom past the free ends 402*a*, 404*a* thereof to effectively extend the upper horizontal plates 402, 404 and accordingly forming an extension 501*a* of the gap therebetween, although the gap extension need not necessarily have the same width as the gap 500 at the free end of the upper plates 402, 404 as shown in the drawings where the gap is narrowed by the second extension plate 504 that curves part way toward the first extension plate 502, which projects linearly from the first upper plate 402, before then projecting further away from the upper plates in a linear manner parallel to the first extension plate 502. The illustrated embodiments each feature additional third and fourth extension plates 506, 508 of rectangular shape sitting atop the first and second extension plates 502, 504 respectively to project past distal ends thereof opposite the upper plates 402, 404 at an elevation flush therewith. Together facing inner edges of the third and fourth extension plates 506, 508 defining boundaries of a second gap extension 501*b* therebetween are positioned flush or coplanar with corresponding edges of the rectangular linear extending portions of the first and second extension plates 502, 504.

The transition pulleys 320, 322 that define the outlet of the tag turning section 300 are double sheave pulleys that also define the inlet of the tag spreading section 500. With reference to FIGS. 7 and 8, the twisted belts 324, 326 of the tag turning section 300 engage about top sheaves 366, 368 of the transition bearings 320, 322. First and second untwisted endless belts 510, 512 of the tag spreading section 500 are entrained about first and second pulley sets that respectively include bottom sheaves 514, 516 of the first and second transition pulleys 320, 322 and first and second end pulleys 518, 520. These ends pulleys 518, 520 are supported on the third and fourth extension plates 506, 508 to sit past the free distal ends thereof at positions having at least portions of the first and second end pulley 518, 520 horizontally aligned with the gap extensions 501*a*, 501*b* between the extension plates so that the end pulleys lie at least partly over an imaginary extension of the gap past the free distal ends of the extensions. At positions spaced along the gap 500 and first gap extension 501*a*, a group of first inner guide pulleys 522 are connected to the first upper plate 402 and first extension plate 502 for support of a portion of each first inner guide pulley's periphery proximate a widthwise center of the gap. At other positions spaced along the gap 500, a group of second inner guide pulleys 524 are connected to the second upper plate 404 for support of a portion of each second inner guide pulley's periphery proximate the widthwise center of the gap at a position between two adjacent ones of the first inner guide pulleys 522. A group of two first outer guide pulleys 526 complete the first pulley set about which the first untwisted belt 510 is entrained and are mounted atop the first upper plate 402 at a distance from the space between the upper plates 402, 404 between this space and the front wall 310 of the housing 308 on opposite sides of the transition pulleys 320, 322 along the lengthwise direction of the apparatus. A group of two second outer guide pulleys 528 complete the second pulley set about which the second untwisted belt 512 is entrained and are mounted atop the second upper plate 404 at a distance from the space between the upper plates 402, 404, one where the gap 500 between the upper plates 402, 404 curves at a position along this curve just before the one of the second inner guide pulleys 524 nearest the free distal end 404*a* of the second upper plate 404 and the other further outward from the gap 500 at the linear portion thereof proximate the distal end 308*a* of the housing 308.

The pulleys of the first and second sets of the pulleys all rotate about vertical axes and are situated in a common horizontal plane over the coplanar upper plates 402, 404. Inner sections of the untwisted belts 510, 512 extending between the transition pulleys 320, 322, between the first and second groups of inner guide pulleys 522, 524 and between the first and second end pulleys 518, 520 are situated in face-to-face in contact with, or close proximity to, one another so as to frictionally grip four face-to-face tags between outer faces of these inner sections, outer face again referring to the face of a belt that faces away from a pulley as it wraps thereabout. With the peripheries of the inner guide pulleys 522, 524 and the end pulleys 518, 520 having portions thereof positioned adjacent the approximate center lines of the gap 501 and the second gap extensions 501*a*, the inner sections of the untwisted belts 510, 512 generally follow this approximate center line to define a delivery path between them from the transition pulleys 320, 322 to the effective ends of the upper plates 402, 404 provided by the extension plates. The top and bottom sheaves of the double sheave transition pulleys are coaxial and of equal diameter. The four tags having been stood upright by the twisted belts of the tag turning or verticalizing section 300 are frictionally grasped by the untwisted belts of the tag spreading section 500 just as they are released from the frictional grip between the twisted belts.

To prevent slack in the untwisted belts 510, 512 of the tag-spreading section and thereby ensure the tags are firmly gripped between the inner sections thereof, the first and second inner guide pulley's 522, 524 alternating sequentially along the travel path over the gap 500 is each supported to position the portion of its periphery engaged by the respective untwisted belt slightly past the approximate centerline of the gap that the belts' inner sections are intended to generally follow, that is, on the side of this approximate centerline opposite the respective upper plate on which the pulley is supported. The inner sections of the untwisted belts 510, 512 thus slightly zig-zag or move back and forth across the approximate center line from pulley to pulley, but thereby overall generally follow the approximate center line. With the curved facing-together inner edges of the upper plates 402, 404 producing a curved portion of the gap 500, the travel path defined between the inner sections of the untwisted belts 510, 512 generally follows or approximates this same curve over the curved portion of the gap 500.

The inner section of the first untwisted belt 510 and the inner section of the second untwisted belt 512 are thus defined on inside and outside sides of the travel path's curve. The transition pulleys 320, 322, all sheaves of which are equally sized, are driven at the same speed of rotation in opposite directions by the motor 146 of the conveying assembly, as the bottom drive pulleys 348, 350 are of equal diameter and the vertical shafts 316, 318 are all of equal diameters. The inner sections of the untwisted belts 510, 512 thus move along the travel path at the same speeds, but because the first untwisted belt 510 is situated on the inside side of the travel path curve, it travels a slightly lesser distance over the length of the curve than the second untwisted belt 512 situated on the outside side of the travel path curve. Moving at the same speed as the second untwisted belt 512 but over a shorter distance along the travel path curve, the first untwisted belt 510 is thus going to develop a slight lead on the second untwisted belt when moving through the curved portion of the travel path. That is, a point on the outer face of the inner section of the first untwisted belt 510 aligned with a point on the outer face of the inner section of the second untwisted belt 512 as the points leave the counter-rotating transition pulleys 320, 322 with a group of tags positioned between the belts at these points will travel slightly further along the curved travel path than the point on the second belt and thus end up unaligned with the point on the second belt across the travel path after having spanned the curved portion thereof and thus be a short distance ahead of the point on the second belt along the travel path.

Tag Spreading Section—Operation

Figure 16:
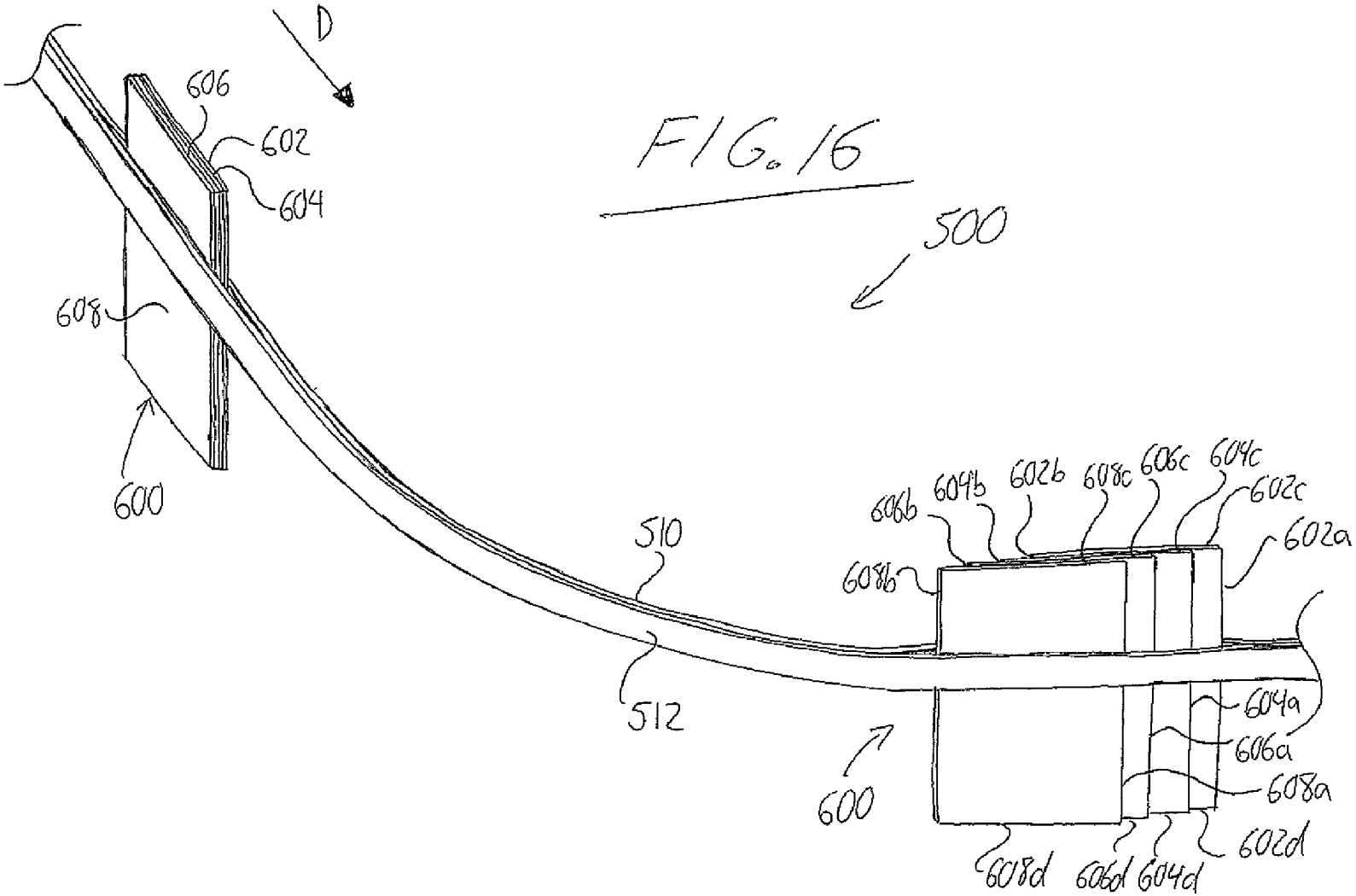
FIG. 16 is a schematic illustration demonstrating the function of the tag spreading section of the apparatus.

FIG. 16 schematically illustrates how a vertically oriented group of tags 600 received from the tag turning section 300 is manipulated by the untwisted belts 510, 512 of the tag spreading section 500 by showing two sequential groups of tags being moved along the travel path thereof from the transition pulleys toward the end pulleys in a working direction D of the apparatus. The group of tags 600 having been stacked face-to-face atop one another by the stacking section 100 and then turned upright to situate the planar tags side-by-side in adjacent vertical planes by the tag turning section 300 can now be described as including an innermost tag 602, inner middle tag 604, outer middle tag 606 and outermost tag 608, listed sequentially from the inner section of the first untwisted belt 510 to the inner section of the second untwisted belt 512, i.e. from the inside of the travel path curve to the outside thereof. An inner face of the innermost tag 602 is frictionally engaged directly by the outer face of the first untwisted belt 510, the outer face of the outermost tag 608 is frictionally engaged directly by the outer face of the second untwisted belt 512, and the middle tags 604, 606 are frictionally held in face-to-face contact with the innermost and outermost tags 602, 608 and one another at respective positions therebetween. In the embodiment of FIG. 16, the tags are rectangular and equally sized, having equal lengths and widths oriented respectively oriented vertically and horizontally when received in the vertical configuration from the tag turning section 300. Each tag has a leading vertical edge, a trailing vertical edge, a top horizontal edge and a bottom horizontal edge in this vertical configuration, these edges of each tag being labeled a, b, c and d respectively in combination with the reference character of that particular tag, e.g. 602*a* being used to label the leading vertical edge of the innermost tag 602.

The travel path is the path followed by the group of tags 600 sandwiched between the untwisted belts 510, 512 as it moves with these belts toward the end pulleys 518, 520 where the group is released by the apparatus for entry to the bag-closing sewing machine. The thickness of the group of face-to-face tags 600 between the belts spaces the belts apart across the travel path and thus creates the difference in the distance that the two belts travel along this path. Moving at the same speed as the second belt 512 but traveling less distance along the path than the second belt 512 as a result of being on the inside of the path's curve, the portion of the first belt 510 engaging the surface of the innermost tag 602 moves slightly forward along the travel path in the working direction D relative to the portion of the second belt 512 engaging the surface of the outermost tag 608 as the belts follow the curved portion of the travel path. The frictional contact between the innermost and inner middle tags 602, 604 pulls the inner middle tag 604 partially forward with the innermost tag 602 relative to the outermost tag 608, but not as far as the innermost tag 602. Similarly, the frictional contact between the inner middle and outer middle tags 604, 606 pulls the outer middle tag 606 partially forward with the inner middle tag 604 relative to the outermost tag 608, but not as far as the inner middle tag 604. Just as the friction between the first belt 510 and the innermost tag 602 is greater than the friction between the adjacent tags and therefore pulls the innermost tag 602 further forward than the middle tags 604, 606, the greater friction between the second belt 512 and the outermost tag 608 prevents the outmost tag 608 from moving forward relative to the second belt with the other tags.

As shown in FIG. 16, the innermost tag 602 having moved further along the horizontal travel path than the other tags 604, 606, 608 has thus been shifted relative to the other tags to remain in a face-to-face position relative to the other tags, but to no longer be aligned therewith, instead only overlapping the other tags and project partially outward past the leading perimeter edges thereof to situate its vertical leading edge 602*a* at a distance outward from the other tags. The inner middle tag 604 likewise projects forwardly outward from the adjacent outer middle tag 606, just as the outer middle tag 606 likewise projects forwardly outward from the adjacent outermost tag 608. The group of tags 600 is thus spread out by the cooperation of the untwisted belts as they move through the curved portion of the travel path, leaving the tags positioned face-to-face in adjacent vertical planes but spreading them out to horizontally overlap but not horizontally align with one another and to space apart the leading edges 602*a*, 604*a*, 606*a*, 608*a* sequentially front to rear from the innermost tag 602 to the outermost tag 608. Being of equal widths defined by their horizontal top and bottom edges, the tags also have their lengthwise trailing edges 602*b*, 604*b*, 606*b*, 608*b* situated sequentially front to rear from the innermost tag 602 to the outermost tag 608.

As the horizontally extending untwisted belts 510, 512 and corresponding horizontal travel path are parallel with the top edges 602*c*, 604*c*, 606*c*, 608*c* and bottom edges 602*d*, 604*d*, 606*d*, 608*d* of the rectangular tags of the FIG. 16 embodiment, the top and bottom edges of the tag remain aligned through the spreading, staggering or splaying of the grouping of tags. The tags are thus delivered to the sewing machine to be fixed at equal elevations thereon adjacent the edges of the bags mouth or opening to be stitched closed to ensure attachment of all tags to the bag by a single horizontal stitch line, but horizontally splayed out so that each card projects out to one of its vertical edges past the respective vertical edge of the immediately adjacent tag in the group.

Adjustability

Figure 12:
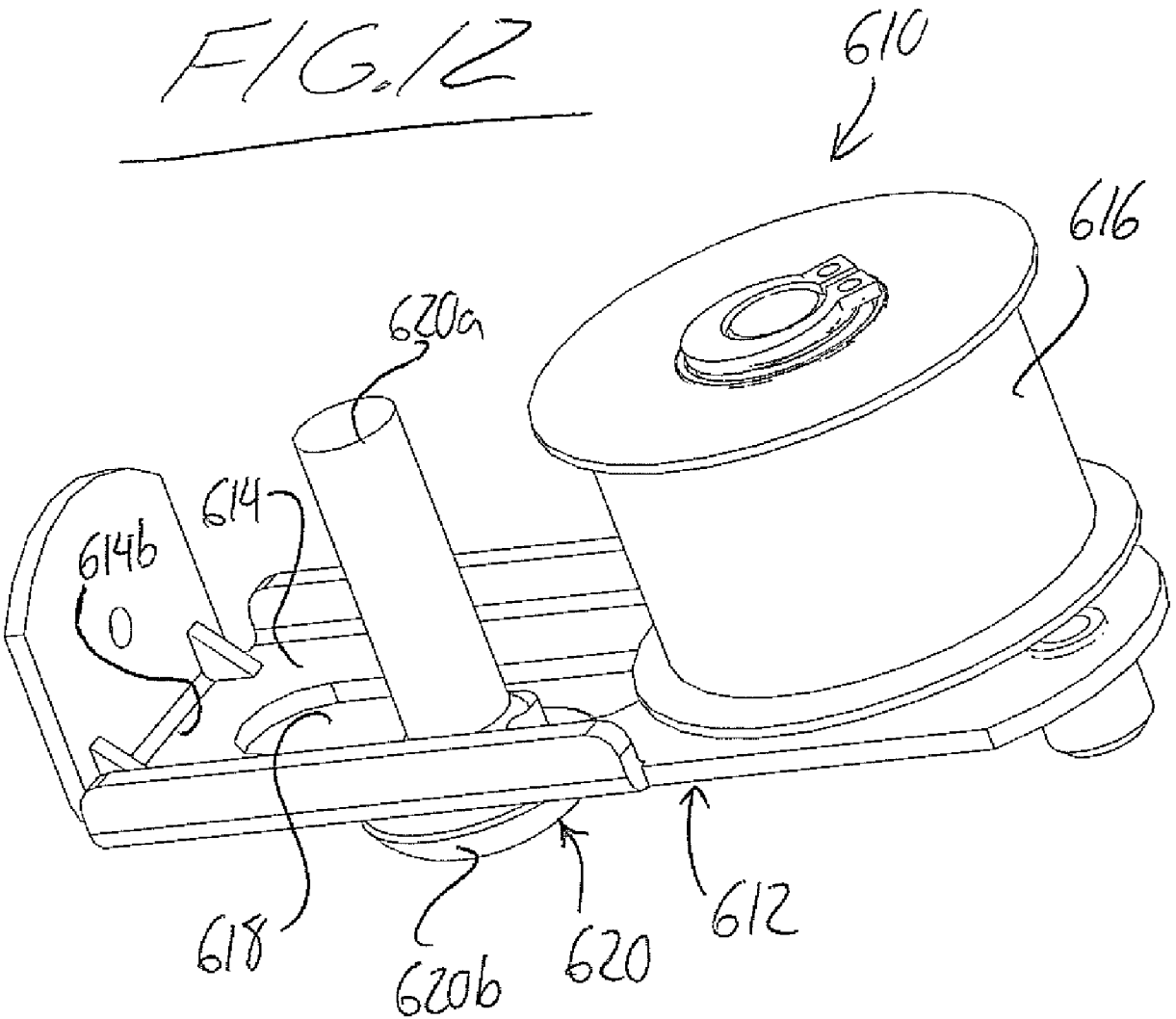
FIG. 12 is an isometric view of one of many pulley units used in the tag turning and tag spreading sections of the apparatus.
Figure 3:
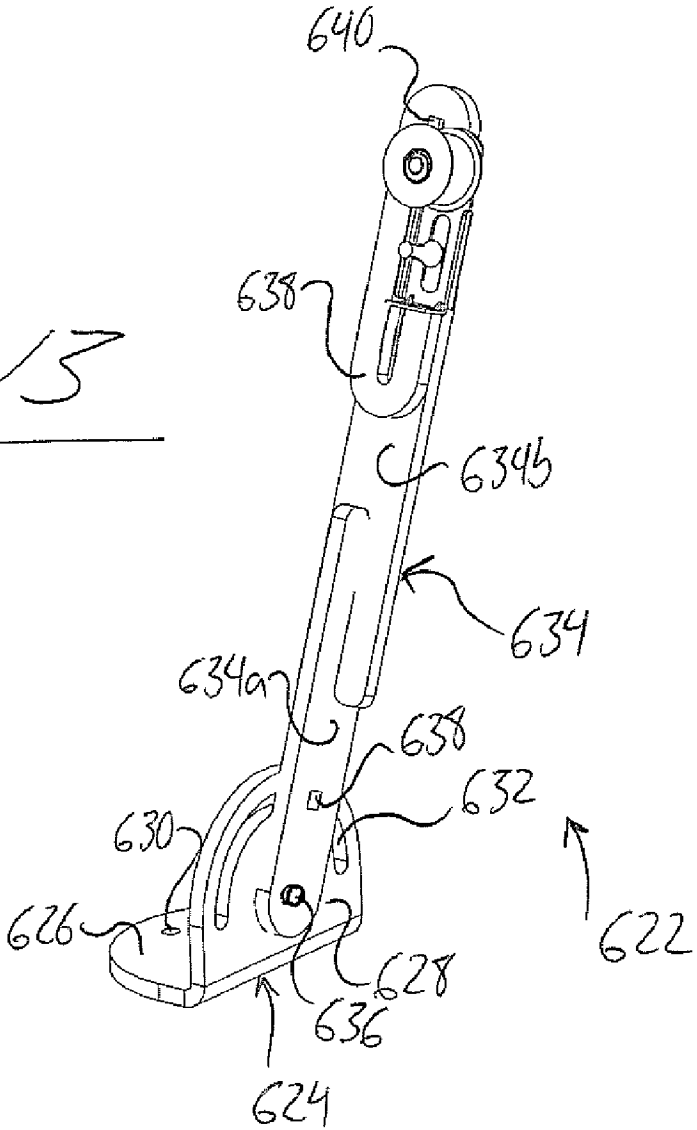

FIG. 12 shows a pulley unit 610 used to define each of the guide pulleys and end pulleys of the tag-turning and tag spreading sections 300, 500. Each unit features a base member 612 having a plate-like planar bottom 614 atop which a pulley 616 is rotatably supported in a conventional manner for free rotation about an axis perpendicular to the planar bottom 614 proximate a first end 614*a* thereof. A linearly extending elongated slot 618 passes through the planar bottom 614 from adjacent the pulley 616 to adjacent an opposite second end 614*b* of the planar bottom 614. A fastener component 620 has a stem or shaft 620*a* of a suitable diameter for passage through the slot 618 and a head 620*b* of larger diameter impassable through the slot 618 in the planar bottom 614.

As shown in FIGS. 1, 2 and 6, the support arms 332, 334 of the tag turning section, the upper plates 402, 404 mounted on the housing 308 and the extension plates 502, 504, 506, 508 connected to the upper plates 402, 404, referred to generally as support plates below, all feature elongated slots extending therethrough with widths similar to the slot 618 of the pulley unit 610. The pulley units are positioned over the support plates to overlap the pulley unit slots with the housing-supported support plates for passage of the fastener stem 620*a* through aligned portions of the overlapping slots and fixing of a releasable fastening component to the stem 620 from an end thereof opposite the fastener head 620*b* on an opposite side of the face-to-face support plate and pulley base bottom 614 to clamp the pulley base 612 in place in a desired position. With the fastener components separated or loosened, the pulley base 612 can be slid along or pivoted relative to the slot in the support plate to reposition the pulley 616, and separation of the fastener components facilitates remove of the pulley unit from the apparatus altogether or temporary withdrawal therefrom for repositioning thereof at a different slot. The number and positions of the pulleys may be modified as desired, for example to change the amount of curve in the belts of the tag spreading section to suit an angle of approach required for a particular sewing machine and bag conveyor setup or to increase or decrease the degree of spread in each grouping of tags being conveyed by the apparatus to the sewing machine inlet. The curve or travel path need not necessarily follow the center line of the gap between the upper plates, but should be positioned over the gap when the inner guide and end pulleys are situated in close overhead proximity to the upper plates, like in the illustrated embodiments, so that the tags hanging from the tag spreading belts can depend downward through the gap.

The illustrated embodiments feature curved slots in the upper plates adjacent to and following the curving gap therebetween, linear slots in the linearly extending portions of the extension plates adjacent and parallel to straight edges thereof defining opposite sides of the gap extensions, linear slots in the upper plates parallel and adjacent to the linear portion of the gap therebetween, and linear slots in the rectangular elongate portions of support arms extending parallel to the lengthwise dimension of these portions. An arcuate slot in the second support arm 334 follows the arcuate edge thereof at a position adjacent thereto. Additional slots are formed in the upper plates at other positions thereon. A slot or hole equipped spacer block can be positioned between the bottom of a pulley unit and the support plate on which it is to be mounted to adjust the elevation of the pulley, for example at the first extension plate 502 to keep the guide pulley thereon at the same elevation as the other guide pulleys.

FIG. 13 shows a tilted pulley support 622 for carrying the obliquely mounted guide pulley 336. A base plate 624 bent at a right angle has a horizontal leg 626 of U-shaped profile and a vertical leg 628 of U-shaped profile, each having an arcuate curved edge portion opposite the integral connection the perpendicular legs. Two mounting holes 630, only one of which is seen in FIG. 13, pass perpendicularly through the horizontal leg 626 for fastening to the bottom wall 314 of the housing 308, as shown in FIG. 8. An arcuately curved slot 632 passes perpendicularly through the vertical leg 628 and follows the arcuate edge portion thereof adjacent this edge. An elongate arm 634 has a first plate-like portion 634*a* situated flush against the vertical leg 628 of the base plate 624 on a side thereof opposite the horizontal leg 626. A pivot pin 636 passes perpendicularly through the vertical leg 628 and first arm portion 634*a* along an axis forming the radial center of the arcuate slot 632. A hole 638 passes perpendicularly through the first arm portion 634 in alignment with the arcuate slot 632 to move therealong under pivoting of the arm 634. A releasable fastening arrangement like that used to lock the pulley units in place, for example a nut and bolt, is used to lock the arm 634 a desirable angle relative to the plane of the horizontal leg 626 by passing through the aligned hole and slot to releasably clamp the arm and vertical leg together.

A second portion of the arm 634*b* is fixed to the first portion 634*a* to extend from and end thereof opposite the base plate 624 in the same longitudinal direction, but is plate-like in a plane perpendicular to the first portion 634*b*. A slider plate 638 sits face to face with the second arm portion 634*b* at a distance from the first arm portion 634*a*, the slider plate 638 having a linearly extending elongated slot 640 therethrough extending parallel to the longitudinal direction of the arm. The second arm portion 634*b* has a pair of holes therethrough spaced apart therealong at a distance from the first arm portion 634*a* so that the slot 640 of the slider plate can be moved to align with one or both of the holes for passage of another fastening arrangement through the hole and slot and tightened to lock the slider plate at a desired position along the second arm portion. Under loosening of the fastening arrangement, the slider plate 638 is slidable along the longitudinal direction of the arm 634 to adjust projection of the slider plate past the end of the arm opposite the base 624 and thereby change the effective length of the arm. A pulley is secured to the slider plate. Through adjustment of the length and angle of the arm, the position and orientation of the obliquely mounted pulley of the above-described tag turning section can be adjusted to engage the respective twisted belt at a desirable location. Two parallel linear slots 642 in the bottom wall 314 of the housing 308 (FIG. 8) extend perpendicular to the front and side walls 310, 312 thereof and align with the mounting holes 630 of the horizontal leg 630 of the base 624, which are spaced along the horizontal leg in a direction perpendicular to the vertical leg. Fasteners pass through these holes 630 and corresponding slots 642 for tightening to lock the base 624 in place and loosening to allow sliding thereof along the bottom wall 314 of the housing to allow further adjustment of the obliquely supported pulley in the tag turning section.

Figure 17:
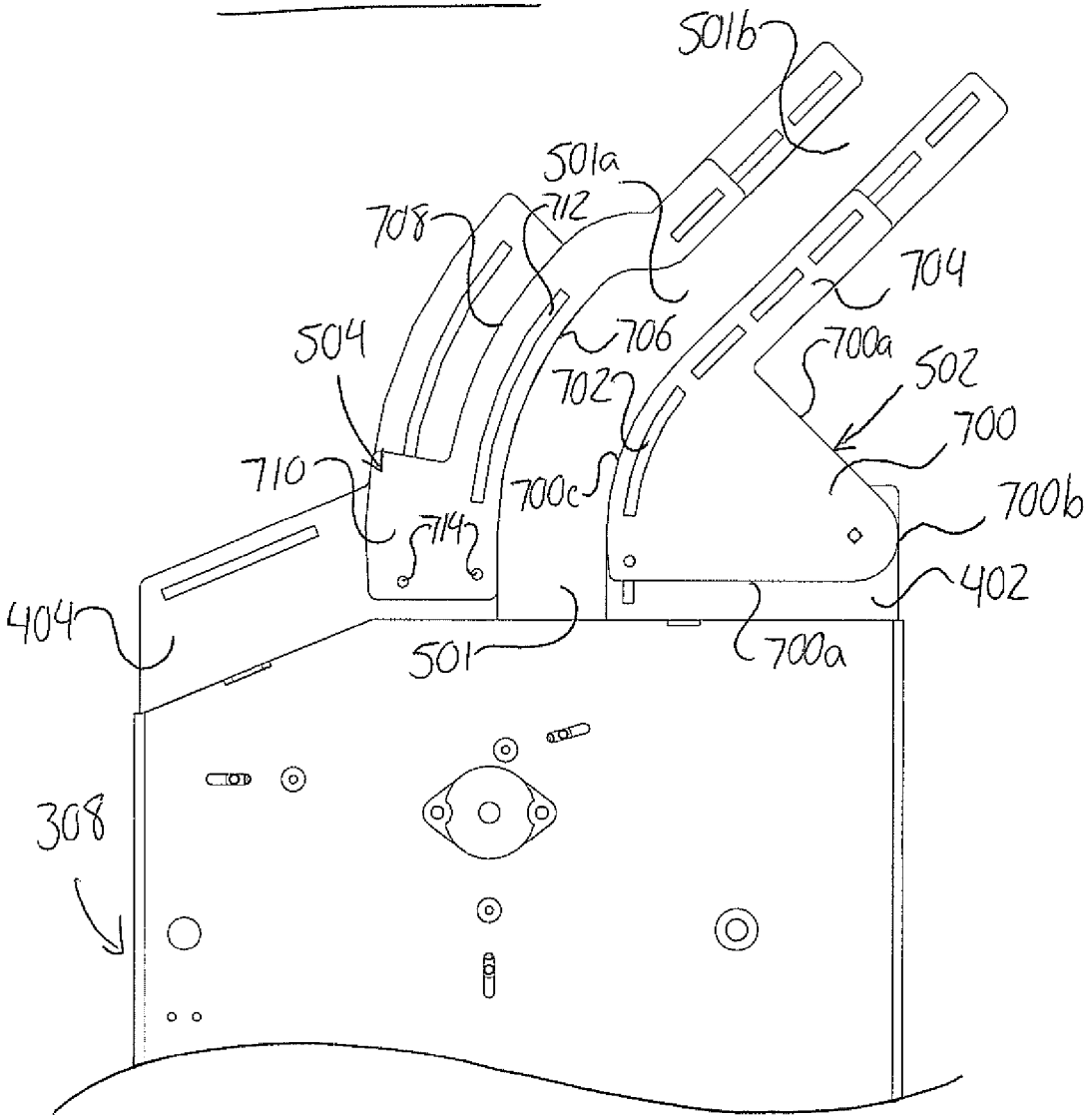
FIG. 17 is a partial bottom plan view of the tag turning and tag-spreading sections of the apparatus.

FIG. 17 shows the mounting of the first and second extension plates 502, 504 of the tag spreading section 500 from below. The first extension plate 502 features an attachment portion 700 having the general shape of a sector or pie-piece except for a rounding of the narrower pointed end. Two linear sides 700*a* thus diverge from the rounded narrower end 700*b* toward a wider arcuate end 700*c* spanning approximately forty-five degrees, the wider arcuate end being length and radius as the arcuately curved inner edge of the first upper plate 402 defining a respective side of the curved portion of the gap 501 between the upper plates 402, 404. An arcuate slot 702 extends through the attachment portion 700 adjacent to and concentric with the arcuate end thereof. The attachment portion 700 is pivotally connected to the first upper plate 402 at the radial center of these arcs for selective horizontal pivoting further out from under the first upper plate 402 from the position of FIG. 17 where the one of the linear sides 700*a* of the attachment portion 700 is parallel to the angled distal end 402*a* of the first upper plate 402. The arcuate slot 702 in the first extension plate 502 aligns with the one of the arcuate slots in the first upper plate 402 nearest the gap 501 so that after pivoting of the extension plate 502 into a desirable position, a fastener arrangement can be passed through the aligned slots to releasably clamp the first upper and extension plates together. The aforementioned linear extending portion of the first extension plate 502 is a rectangular portion 704 that is a continuous extension from the end of the attachment portion's arcuate end opposite the housing 308 on which the upper plates 402, 404 are mounted. By pivoting the first extension plate outward away from the housing 308, one can increase the length of curving portion of the gap 501 to increase the spreading effect of the tag spreading section or tailor the angle at which the tags approach the sewing machine inlet.

The second extension plate 504 has an inner edge 706 with an arcuate portion of equal radius and approximate equal length to an arcuately curved inner edge of the second upper plate 404 defining the respective side of the curved portion of the gap 501. An outer arcuate edge 708 of the second extension plate 504 concentrically follows the inner edge 706 at a first distance therefrom at an end of the extension plate 504 nearest the housing 308, then steps down to a narrower second distance from the inner edge 706 further therealong, thereby defining a wider end 710 of the extension plate 504 nearest the housing 308. An arcuate slot 712 is defined through the extension plate 504 along the narrower arcuate portion thereof to align with an inner one of the arcuate slots in the second upper plate 404. A pair of mounting holes 714 are also provided in the wider end portion 710 of the extension plate 504 and are spaced apart between the arcuate inner and outer edges by a distance corresponding to the radial difference between the inner and outer arcuate slots of the second upper plate 404. Using releasable fasteners to pass through the one of the holes and the other hole or the slot in the second extension plate 504 and through the two arcuate slots in the second upper plate 404, the second extension plate 504 can be clamped in place after sliding away from the housing 308 along gap 501 beneath the second upper plate 504 to cooperate with corresponding adjustment of the first extension plate 502 and lengthen the curved portion of the gap and corresponding curved portion of the tags' travel path.

Overall System and Method

Although the operation of the stacking section is described herein above in terms of steps and indexing of the chain conveyor lugs forward in single step increments, it will be appreciated that operation of the apparatus may be carried out with continuous running of the motor 146 and proper timing of the actuation of the dispenser motors to dispense tags to the trays over the conveyor at the proper intervals between arrival of sequentially adjacent lug sets each tray. The timing of the drive components can be automatically controlled using a PLC system incorporating connections to the motor driving the conveyor of the tag stacking section and the belts of the tag turning and tag spreading section and connections to the motor and tag sensors of the dispensers. The PLC can be programmed to implement the initialization sequence upon an initialization input from an operator and subsequently carry out the repeating sequence on a continual basis until such time as a dispenser sensor indicates that a dispenser has run out of source tags, or a user-inputted stop signal is received. Of course the control system may be arranged to receive other inputs, for example to monitor other sensors used to detect potential safety hazards or complications in the bag conveying or bag sewing machines in a system incorporating the bag feeding apparatus of the present application. Control system components may be housed within the control center box 25 provided on the apparatus frame of the illustrated embodiments, as shown in FIG. 2.

Figure 18:
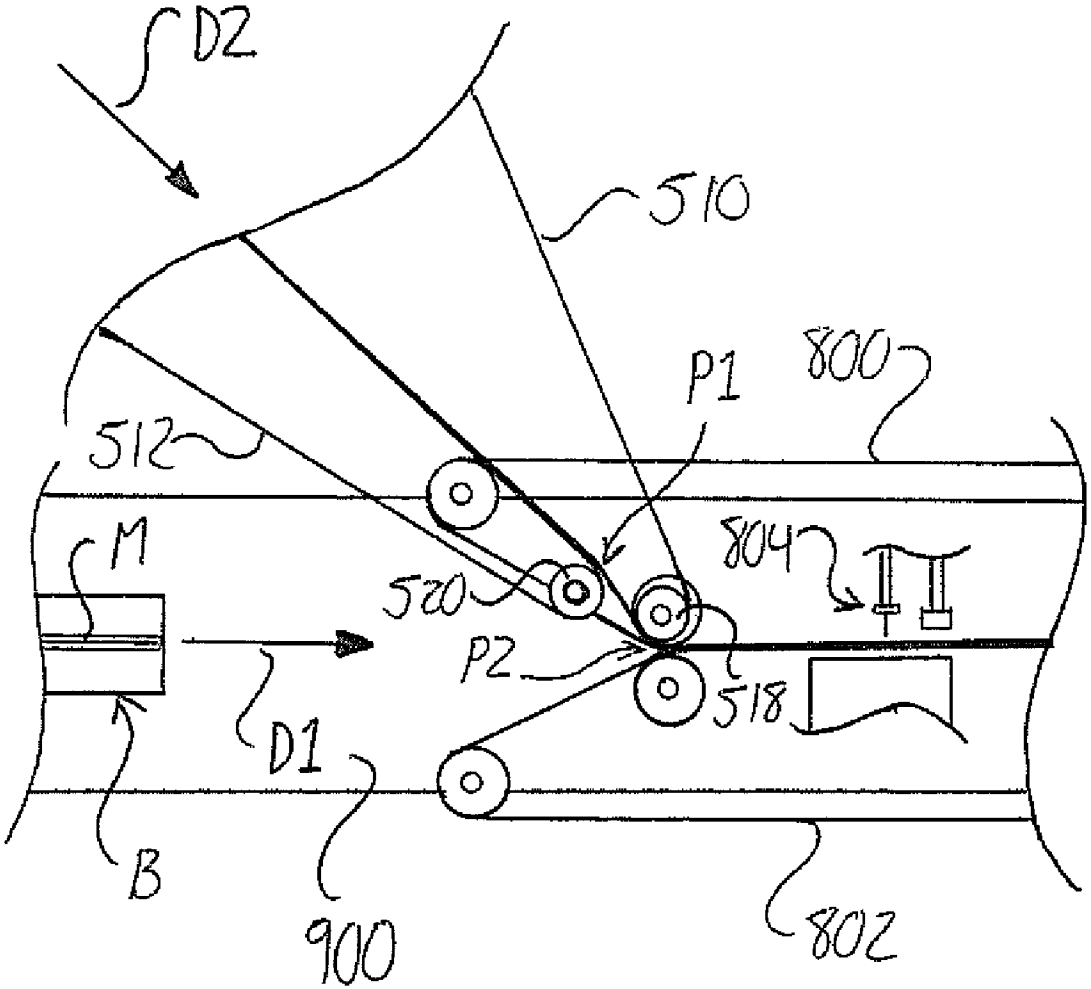
FIG. 18 is a partial schematic overhead view of a bag-closing and bag-tagging system incorporating the tag feeding apparatus of FIG. 1 to feed a group of tags into the infeed of a bag-closing sewing machine as a bag is delivered thereto by a conveyor.

FIG. 18 schematically illustrates integration of the tag feeding apparatus into a system for simultaneous individual closing and tagging of each bag in a series of sequentially fed bags of a product. The untwisted belts 510, 512 of the tag spreading section of the tag feeding apparatus are situated at an elevation a short distance above infeed belts 800, 802 of a conventional bag closing sewing machine, that in a known manner run in opposite directions in a common horizontal plane to frictionally grip opposite sides of an unsewn bag mouth between face-to-face portions of the belts to convey the bag through the sewing head 804 to horizontally stitch the bag mouth closed. The face-to-face tag gripping portions of the belts 510, 512 of the feeding apparatus tag spreading section end at a point P1 proximate an intake point P2 of the sewing machine infeed belts 800, 802 where these infeed belts first meet face-to-face with one another to grip each bag B a short distance below the mouth M at the bag's top end. A horizontal conveyor belt 900 installed at an elevation below the infeed belts 800, 802 delivers bags one at a time to the sewing machine infeed in a direction D1 matching the conveying direction of the infeed belts.

The conveyor belt 900 and tag feeding apparatus are controlled relative to one another so that each bag reaches the sewing machine infeed at the same time as a respective group of tags from the tag feeding apparatus. The release point P1 of the tag feeding apparatus belts 510, 512 is positioned a short horizontal distance upstream from the intake point P2 of the sewing machine infeed along the conveyor belt's operation direction D1, and the spacing between these points is less than the width of each tag between its leading and trailing edges moving through the tag spreading section. This way, the sewing machine infeed belts 800, 802 grip each tag at its leading edge just before the trailing edge of the same tag is released from the tag spreading section of the tag feeding apparatus. The timing of this transition is such that the leading edge of the leading tag enters between the infeed belts at approximately the same time as the leading end of the bag mouth M, or at some time after the leading end of the bag mouth M but before the trailing end thereof, so that the tag is frictionally gripped between the bag and the infeed belt 800 on the side of the conveyor belt 900 from which tag is delivered by the tag feeding apparatus. The tags spread out by the tag feeding section, but still overlapping one another, maintain this spacing as they are delivered to the sewing machine. As an alternative to simultaneous delivery of the bag and tag grouping to the infeed, the bag may instead first be conveyed to the inlet point of the infeed, or even partly past this point so that only a leading portion of the bag mouth is gripped between the infeed belts 800, 802, at which time a sensor on the sewing machine infeed may detect the presence of the bag and provide a signal to the control system of the tag feeding apparatus to drive the tag-spreading belts to deliver the respective tag grouping to the sewing machine infeed. As the tags reach the infeed, the infeed belts are then again activated to pull the bag and its tags together to the sewing machine head.

With reference to FIG. 16, once the sewing action is completed to close the mouth of the bag and secure the tags thereto, the leading tag is fully visible from the side of the bag onto which it is sewn, and the trailing edge of each subsequent tag projects outward from the tag situated over it so that all tags are visible to a viewer who can therefore easily confirm the presence of each and every tag without having to pull the unsewn bottom end of any tag out from the bag to see the next tag beneath it. The presence of each of the tags is thus visually confirmable, while the total area of the bag's side covered by two of the overlapping tags is reduced relative to prior art 2-tag placement systems in which the tags are sewn in a non-overlapping side by side manner.

As the top ends of the tags are to be positioned at approximately the same elevation of the top end of the bag, the tag spreading belts 510, 512 of the tag feeding apparatus approach the sewing machine infeed from one side of the bag conveyor 900 and do not extend past the linearly extending face-to-face portions of the infeed belts 800, 802 generally centered over the conveyor belt width. Alternatively, the tag spreading belts 510, 512 of the tag feeding apparatus may extending slightly past this central feed line of the sewing machine a distance sufficiently short so that the bag conveyed past the release end of these belts 510, 512 can deflect therearound on its way to the infeed. In the known illustrated infeed arrangement, the infeed belts 800, 802 are spaced apart at the inlet end of the infeed and converge toward one another to ensure the bag is guided toward the center or feed line of the sewing machine even if not perfectly aligned with this center line as it approaches the infeed. With the tag spreading belts 510, 512 extending not at all, or only slightly, past the center or feed line of the sewing machine, the tag spreading belts therefore do not block or interfere with feeding of the bag's top end into the sewing machine infeed. A direction of approach D2 at which the tags approach the sewing machine infeed after going through the travel path curve of the tag spreading belts 510, 512 is at an oblique angle to the conveyor belt and sewing machine infeed direction D1, this angle being acute as measured in the infeed direction D1 so that, using a two dimension rectangular coordinate system to describe these directions a viewed in a horizontal plane, these directions share a common direction component. In other words, the tags move along, not against, the conveyor belt and sewing machine infeed direction D1 as they approach the sewing machine infeed in direction D2.

Variations

Although the illustrated embodiments have four dispensers to dispense four different tags, the apparatus may have as few as two dispensers or possibly more than four. The apparatus may be used to feed tags in groups of any number, from one tag per group up to the a maximum determined by and equal to the number of dispensers.

A number of different mechanical devices for stacking single sheets one atop the other in an aligned manner are known, particularly in the book-making industry and it may be possible to use such stacking devices in place of the tag stacking section of the tag feeding apparatus of the illustrated embodiments to prepare the different tags into a stacked grouping for receipt between the belts of the tag turning section. If existing device are able to deliver groups of face-to-face tags in an upright orientation with the tags vertically oriented in side-by-side vertical planes, it may be possible to use such a device to deliver tags to the tag spreading section, which could then use single sheave inlet pulleys in place of the transition pulleys of the illustrated embodiments shared by the tag turning and tag stacking sections. It will be appreciated that the twisted belt arrangement of the illustrated tag-turning section may be used with a stacking device that places the stacked tags completely horizontally rather than on a gently sloped surface like the conveyance plate 106 of the illustrated embodiments, in which case the inlet pulleys would lie in a vertical plane for rotation about horizontal axes and the belts would accordingly twist through ninety degrees to turn the group of tags from their horizontal orientation in the vertical stack to the vertical upstanding orientation for feeding into the tag spreading section. Furthermore, it will be appreciated that the tag carrying belts of the tag spreading section need not necessarily be completely horizontally oriented as they are in the illustrated embodiments where tags hang straight and vertically downward from the belts, and accordingly the tag-turning section need not necessarily orient the group of tags completely vertically.

The conveyor in the stacking section of the illustrated embodiments uses three endless flexible elements in the form of individual chains of interconnected links. It will be appreciated that the number of endless flexible elements used in the conveyor may be altered. For example a pair of two lug-carrying endless elements cooperating with two slots in the conveyance plate above them may be sufficient to propel the tags forward and maintain a desirable orientation of the tags trailing edges during this conveyance. It may be possible to use belts as the endless elements having the lugs fixed thereto in place of the chains. It may also be possible to have a single endless flexible element carrying the aligned sets of lugs with lugs of each set spaced apart on a mount or support fixed to the endless development to extend in a direction transverse thereto.

It will be appreciated that friction feed dispensers other than those of illustrated embodiments are known in the art for one-at-a-time feeding of an individual sheet, tag, card or label from a source pile or stack, and may be used in the stacking section of the apparatus in place of the illustrated dispensers. Other single sheet dispenser types are also known and could similarly be incorporated into the stacking section in place of the illustrated dispensers. For example, vacuum based devices using application of a vacuum or suction to grip a single sheet from a supply source for repositioning are known and used in the prior art patents mentioned herein above. However, in the multi-tag feeding apparatus of the present application where different tags are retrieved from different sources, the use of friction feeders offers a simplified construction of the apparatus, using only rotationally driven components and requiring no additional air-flow control components.

Although the above description outlines use of a plurality of distinct but equally sized tags to each bag of product to be closed, it will be appreciated that each section of the illustrated apparatus would still be operable with tags of equal dimension in the direction in which the tags are to be shifted relative to one another but differing in the other dimension, so long as this other dimension of each tag is sufficient to span the distance from the guide wall to the inlet rollers of the tag turning section so that the face-to-face belts grip all of the tags stacked along the conveyor. The different tags to be attached to the bag may be of different colours, especially the tags that end up adjacent one another in the stack so that the contrast in colour between adjacent tags makes visual identification of the multiple tags after sewing to the bag easier. For example, in the four tag system of the illustrated embodiments, the presence of four tags on the final product can be easily confirmed at a glance where each tag is a different distinct colour.

In the embodiment of FIGS. 1 to 18, the belts of the tag spreading section are driven at the same speed and rely on their opposed positions on opposite sides of the path followed by the tags frictionally gripped between them to move through different distances in a fixed amount of time to shift the tags relative to one another. It will be appreciated that the amount of spreading may be increased by driving the belt on the inside of the travel path curve at a slightly higher speed than the outside belt. In the embodiment of FIGS. 1 to 18, where the transition pulleys are driven together by a two sided belt entrained thereabout, such a difference in speed may be accomplished by different pulley sizes on the two shafts driving the tag-carrying belts of the tag spreading section. It may be possible that alternative embodiments could use two face-to-face belts driven at slightly different speeds along a non-curving linear travel path to similarly have one of the belts travel slightly further along the travel path during a fixed period of time than the other belt to similarly shift the tags frictionally held between the belts relative to one another to achieve the desired spreading of the tags.

Figure 19:
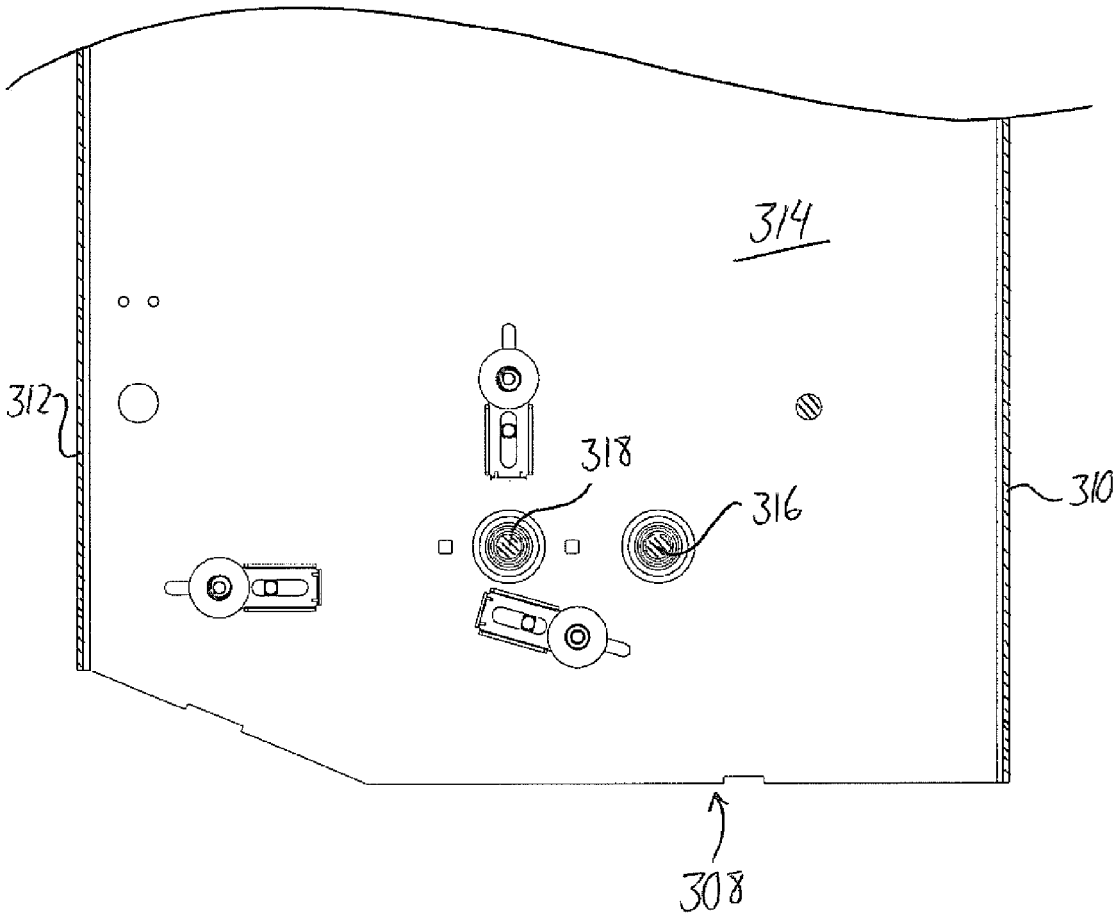
FIG. 19 is a partial cross-sectional view like that of FIG. 9 illustrating an alternate embodiment drive arrangement of the tag feeding apparatus.

FIG. 19 shows an alternate embodiment of the tag feeding apparatus that differs in structure only in that the double sided belt 352 interconnecting the vertical shafts 318, 320 that carry the transition pulleys 320, 322 has been removed. This modifies the drive system of the apparatus in that rotation of the first vertical shaft 316 is no longer directly driven by rotation of the second vertical shaft by rotation of horizontal belt driven pulley 340. Instead, the movement of the first twisted and untwisted belts 324, 510 of the tag turning and tag spreading sections are driven by frictional pulling thereof by the second twisted and untwisted belts 326, 512 respectively engaged face-to-face therewith. This frictional drive of the first untwisted belt 510 on the inside of the curve means that there is some slippage between these this belt and the other untwisted belt 512 on the outside of the curve. In testing of a prototype of the tag feeding apparatus with this drive arrangement, it has been found that the direction in which the tags are spread is the opposite of the direction of spread achieved when the double sided belt used to couple the two vertical shafts 316, 318 together.

That is, when both belts are driven through a coupling of the shafts by the double sided belt, a chain, a gear set or other drive arrangement, the belts 510, 512 of the tag spreading section move at the same speed, and since the belt 510 on the inside of curve moves through a slightly lesser distance along the curved travel path of the belts, this inside belt thus gains a slight lead, and accordingly the tag on the inside of the curve ends up as the leading tag after the spread of the tag grouping. However, when only the outside belt 512 is directly driven through its respective vertical shaft 318, slippage between the belts occurs and the outside belt 512 ends up leading the frictionally pulled inside belt 510. Both arrangements are relying upon a small difference in the distances through which the two belts are moved within a single common time frame to shift the cards relative to one another as they are conveyed along the travel path defined between the two untwisted horizontal belts 510, 512 of the tag spreading section.

Figure 20:
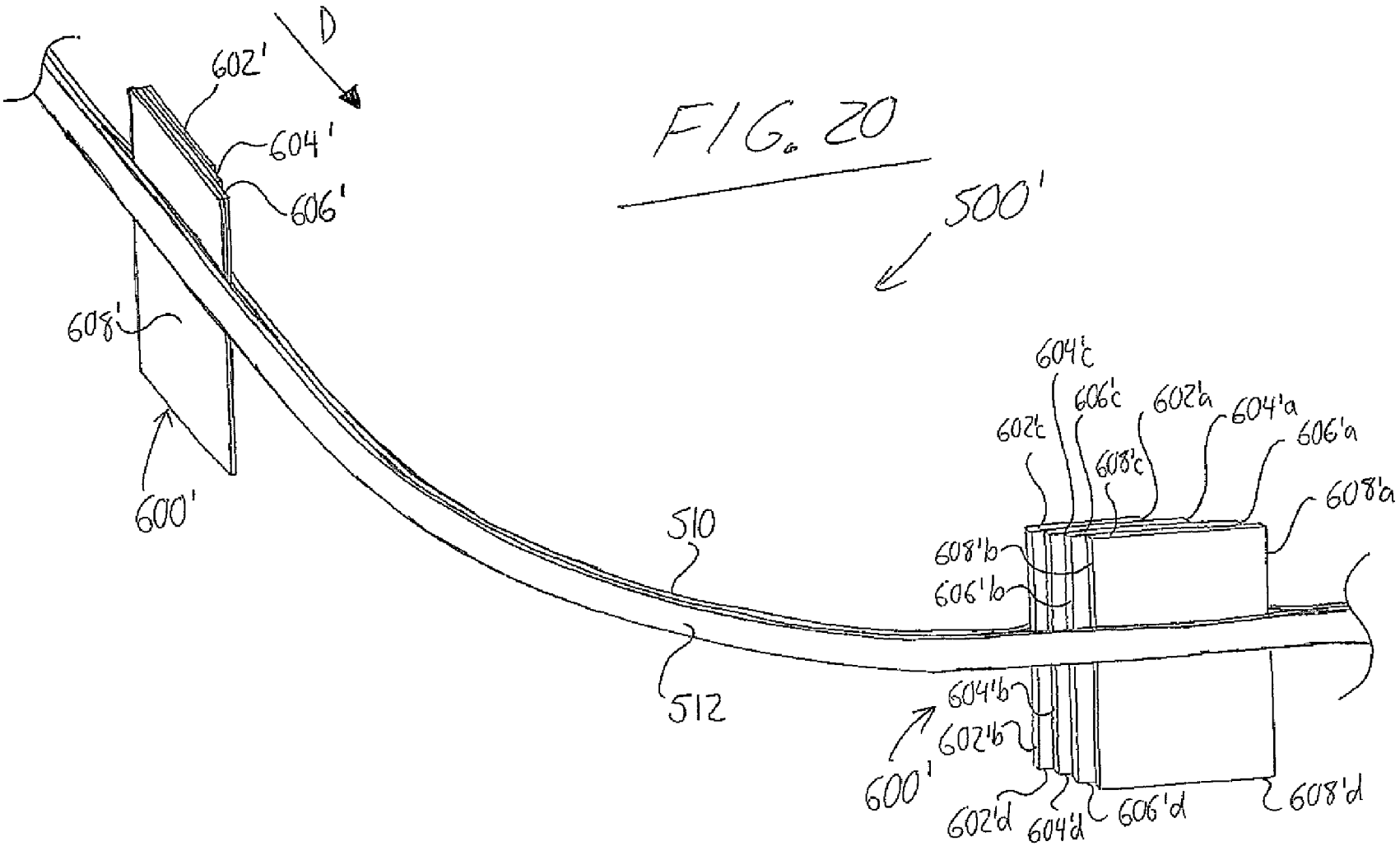
FIG. 20 is a schematic illustration demonstrating the function of the tag spreading section of the apparatus when utilizing the alternate embodiment drive arrangement of FIG. 19.

FIG. 20 schematically illustrates operation of the tag spreading section 500' of the embodiment of FIG. 19, and also illustrates how the apparatus is not limited to use with groupings of identically sized tags in the widthwise dimension in which they are shifted relative to one another. As described for FIG. 16, a group of tags 600' having been stacked face-to-face atop one another by the stacking section 100 and then turned upright to situate the planar tags side-by-side in adjacent vertical planes by the tag turning section 300 can now be described as including an innermost tag 602', inner middle tag 604', outer middle tag 606' and outermost tag 608', listed sequentially from the inner section of the first untwisted belt 510 to the inner section of the second untwisted belt 512, i.e. from the inside of the travel path curve to the outside thereof. In this figure, the four tags are again rectangular, but are not all equally sized, instead having equal vertically oriented lengths but having only two tags of equal horizontal width. The tags have been stacked in such an order in the tag stacking section that the tags are arranged with the outermost tag 608' and the outer middle tag 606' being equal in width and the remaining two inner tags decreasing in width moving from the outside of the belt curve to the inside. Again, each tag has a leading vertical edge, a trailing vertical edge, a top horizontal edge and a bottom horizontal edge in this vertical configuration, these edges of each tag being labeled a, b, c and d respectively in combination with the reference character of that particular tag, e.g. 602'*a* being used to label the leading vertical edge of the innermost tag 602'.

Like the embodiment of FIG. 16, the tags are moved along the travel path and moved relatively short distances relative to one another due to the same frictional engagement of the tags with the belts and with one another. However, since the inside belt 510 in this embodiment is only driven by its frictional contact with the outside belt 512 and experiences some slip relative thereto during travel along the path defined between them, the inside belt will lag behind the outside belt that is driven directly through rotation of its shaft. As shown in FIG. 20, the innermost tag 602' therefore does not move as far along the horizontal travel path as the other tags 604', 606', 608' and thus is shifted relative to the other tags to remain in a face-to-face position relative to the other tags, but to project further outward past the trailing perimeter edges thereof than when it entered the tag spreading section. The inner middle tag 604' likewise projects further rearwardly outward from the adjacent outer middle tag 606' as it moves through the tag spreading section, just as the outer middle tag 606' likewise projects further rearwardly outward from the adjacent outermost tag 608' as it moves through the tag spreading section. The group of tags 600' is thus spread out over its travel through the tag spreading section to further space apart the trailing edges 608'*b*, 606'*b*, 604'*b*, 602'*b* sequentially front to rear from the outermost tag 608 to the innermost tag 602.

In FIG. 20, the trailing vertical edges 602'*b*, 604'*b*, 606'*b* and 606'*b* are shown as being aligned with one another as the tags enter the tag spreading section in order to clearly illustrate the differences in width among the differently sized tags. However, it will be appreciated these trailing edges 602'*b*, 604'*b*, 606'*b*, 606'*b*, having been set in alignment with one another during pushing of the tags along these same edges by the lugs in the tag stacking section, will actually already be offset from one another by a short distance before reaching the untwisted belts 510, 512 of the tag spreading section. The reason for this is that the same belt slippage effect that occurs in the tag spreading section due to the direct shaft-driven operation of only one of the untwisted belts 512 also occurs in the tag turning section since the first untwisted belt 510 of the tag spreading section and the first twisted belt 324 of the tag turning section engage around the same double sheave pulley 320 on the first vertical shaft 316, which is not driven in this embodiment. Therefore, the first twisted belt 324 is moved by the same belt-to-belt frictional engagement as the first untwisted belt 510 of the next section. Due to the slippage in this frictional contact between the belts of each frictionally engaged pair, the first twisted belt 324 of the tag turning section will end up lagging the second twisted belt 326, and accordingly each tag, except for the one held against the second twisted belt 326, will end up shifting relative to the next tag nearest the second untwisted belt so that its trailing edge lags slightly behind that of the next tag. As the order of the tags from the first to second belt in the tag turning section is the same as from the first to second belt in the tag spreading section, this spreading effect is then built upon in the same direction in the subsequent movement of the tags through the tag spreading section, as described above.

Testing of the prototype has been found to produce a larger spreading out of the tags with only the outside belt of the tag spreading section being shaft driven compared to test runs with both of the tag spreading section's belts being shaft driven through interconnection of their shafts with the double sided belt. These embodiments and their results schematically shown in FIGS. 16 and 20 demonstrate how the apparatus can function whether one or both of the belts are directly driven through its respective shaft and pulley set. Although not shown, it will be appreciated that an embodiment in which only the inside belt of the tag spreading section is directly driven, the outside belt of this section being driven only by frictional contact with the inside belt, will also produce a spreading out of the group of tags.

While the illustrated embodiments use a single motor 146 to drive the conveyor of the tag stacking section 100 and the tag conveying belts of the other sections using a gearbox to provide two separate outputs from the same motor, it will be appreciated that other embodiments could use separate conveyor drive motors in some or all sections while still ensuring that the tag stacking section does not feed groups of tags from one section to the sequentially following section faster than the tags move through that sequentially following section in order to maintain spacing between adjacent groups of tags moving through the system.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A tag feeding apparatus for use with a bag-closing and tag-applying sewing machine in order to attach multiple tags to each bag in a sequence of bags delivered to the sewing machine for closing of each bag and simultaneous attachment of the multiple tags by sewing the bag and the multiple tags together along edges of the bag at an opening thereof, the tag feeding apparatus comprising a tag spreader arranged to receive a stack of tags comprising a plurality of different tags that are distinct from one another and stacked together in a face-to-face grouping and arranged to displace the different tags relative to one another along faces of the tags to project each tag partially outward from an adjacent tag next thereto in the grouping of tags;

wherein the tag spreader comprises first and second belts entrained about first and second pulley sets to position the first and second belts face-to-face for movement along a common delivery path defined between face-to-face portions of the first and second belts, the first and second belts being arranged to receive the grouping of tags between the face-to-face portions and be driven to respectively travel unequal fist and second distances along the delivery path in a set amount of time to move the grouping of tags along the delivery path and shift the tags relatively to one another along the delivery path to displace the different tags relative to one another along the faces of the tags to project each tag partially outward from the adjacent tag.

2. The tag feeding apparatus of claim 1 wherein the first and second belts are arranged to be driven at equal speeds along the delivery path and the delivery path is non-linear so that at least a portion of the delivery path curves or approximated a curve.

3. The tag feeding apparatus of claim 1 wherein pulleys of the first and second pulley sets are movably carried on a frame of the tag spreader and selectively lockable to the frame in different positions to reconfigure the delivery path.

4. The tag feeding apparatus of claim 1 wherein the tag spreader comprises support members movably carried on a frame of the tag spreader and selectively lockable to the frame in different positions to reposition pulleys of the first and second pulley sets.

5. The tag feeding apparatus of claim 1 wherein pulleys of the first and second pulleys sets alternate along the delivery path.

6. The tag feeding apparatus of claim 1 comprising a tag stacker arranged to retrieve the different tags from respective tag sources and stack the different tags atop one another face-to-face to define the stack of tags, and a tag turner arranged to receive the stack of tags from the tag stacker and position the grouping of tags to extend upright prior to receipt thereof by the tag spreader.

7. The tag feeding apparatus of claim 6 wherein the tag turner comprises a first pulley pair, a second pulley pair, a first twisted belt entrained about the first pulley pair and a second twisted belt entrained about the second pulley pair, each pulley pair comprising spaced apart input and output pulleys supported for rotation about input and output axes respectively which are angularly offset from one another by a same angle, the input pulleys being positioned adjacent one another with the inlet axes parallel and the output pulleys being positioned adjacent one another with the outlet axes parallel and more upright than the inlet axes, and the twisted belts jointly twisting through the same angle from the input pulleys to the output pulleys and extending face-to-face with one another from between the input pulleys to between the output pulleys to receive the different tags stacked atop one another between the twisted belts at the inlet pulleys and convey the grouping of tags to the outlet pulleys while pivoting them through the same angle as the twisting of the twisted belts to reposition the tags upright.

8. The tag feeding apparatus according to claim 7 wherein the output axes are vertical.

9. The tag feeding apparatus according claim 1 comprising a tag stacker from which the tag spreader receives the stack of tags, the tag stacker comprising a plurality of tag dispensers spaced along a conveyer and each arranged to deliver individual tags one at a time from a source of a respective one of the different tags onto a respective slotted tag tray above the conveyor, the conveyor having upward projections positioned thereon to move through slots in the trays under operation of the conveyor to force a first individual tag off the respective tray of a first tag dispenser and move the first individual tag onward beneath the respective tray of a second tag dispenser where the projections move the first and second individual tags onward together, forcing the second individual tag off the respective tray of the second dispenser onto the first individual tag below.

10. The tag feeding apparatus of claim 9 wherein the trays and surfaces onto which the first individual tag falls from the respective tray of the first tag dispenser slope downwardly away from the tag dispensers to position the tags against wall portions projecting upward from the trays and the surfaces at distances from the dispensers to define guides for aligning edges of the tags prior to receipt thereof by the tag spreader.

11. The tag feeding apparatus according to claim 10 wherein the conveyor comprises at least one endless flexible element entrained about rotatable members and the surfaces onto which the first tag falls are defined above the conveyor and separated along the conveyor by one or more additional slots through which the projections extend upward to contact and move the tags.

12. The tag feeding apparatus according to claim 11 wherein each flexible element comprises a chain and the rotatable members comprise sprockets.

13. The tag feeding apparatus according to claim 9 wherein the conveyor and the tag spreader are both coupled to a common motor for driven operation thereby.

14. A tag feeding apparatus for use with a bag-closing and tag-applying sewing machine in order to attach multiple tags to each bag in a sequence of bags delivered to the sewing machine for closing of each bag and simultaneous attachment of the multiple tags by sewing the bag and the multiple tags together along edges of the bag at an opening thereof, the tag feeding apparatus comprising:

a tag spreader arranged to receive a stack of tags comprising a plurality of different tags that are distinct from one another and stacked together in a face-to-face grouping, the tag spreader comprising first and second belts entrained about first and second pulley sets to position the first and second belts face-to-face for movement along a common delivery path defined between face-to-face portions of the first and second belts, the first and second belts being arranged to receive the grouping of tags between the face-to-face portions and be driven to move the grouping of tags along the delivery path and shift the tags relatively to one another along the delivery path to displace the different tags relative to one another along the faces of the tags to project each tag partially outward from the adjacent tag.

15. The tag feeding apparatus according to claim 14 wherein the delivery path is non-linear so that at least a portion of the delivery path curves or approximated a curve.

16. The tag feeding apparatus of claim 14 wherein the first and second belts are arranged to be driven at equal speeds along the delivery path and the delivery path is non-linear so that at least a portion of the delivery path curves or approximated a curve.

17. The tag feeding apparatus of claim 14 wherein pulleys of the first and second pulley sets are movably carried on a frame of the tag spreader and selectively lockable to the frame in different positions to reconfigure the delivery path.

18. The tag feeding apparatus of claim 14 wherein the tag spreader comprises support members movably carried on a frame of the tag spreader and selectively lockable to the frame in different positions to reposition pulleys of the first and second pulley sets.

19. The tag feeding apparatus of claim 14 wherein pulleys of the first and second pulleys sets alternate along the delivery path.

20. A tag feeding apparatus for use with a bag-closing and tag-applying sewing machine in order to attach multiple tags to each bag in a sequence of bags delivered to the sewing machine for closing of each bag and simultaneous attachment of the multiple tags by sewing the bag and the multiple tags together along edges of the bag at an opening thereof, the tag feeding apparatus comprising:

a tag spreader arranged to receive a stack of tags comprising a plurality of different tags that are distinct from one another and stacked together in a face-to-face grouping and arranged to displace the different tags relative to one another along faces of the tags to project each tag partially outward from an adjacent tag next thereto in the grouping of tags;

a tag stacker arranged to retrieve the different tags from respective tag sources and stack the different tags atop one another face-to-face to define the stack of tags; and a tag turner arranged to receive the stack of tags from the tag stacker and position the grouping of tags to extend upright prior to receipt thereof by the tag spreader.

21. The tag feeding apparatus of claim 20 wherein the tag turner comprises a first pulley pair, a second pulley pair, a first twisted belt entrained about the first pulley pair and a second twisted belt entrained about the second pulley pair, each pulley pair comprising spaced apart input and output pulleys supported for rotation about input and output axes respectively which are angularly offset from one another by a same angle, the input pulleys being positioned adjacent one another with the inlet axes parallel and the output pulleys being positioned adjacent one another with the outlet axes parallel and more upright than the inlet axes, and the twisted belts jointly twisting through the same angle from the input pulleys to the output pulleys and extending face-to-face with one another from between the input pulleys to between the output pulleys to receive the different tags stacked atop one another between the twisted belts at the inlet pulleys and convey the grouping of tags to the outlet pulleys while pivoting them through the same angle as the twisting of the twisted belts to reposition the tags upright.

22. The tag feeding apparatus according to claim 21 wherein the output axes are vertical.

23. A tag feeding apparatus for use with a bag-closing and tag-applying sewing machine in order to attach multiple tags to each bag in a sequence of bags delivered to the sewing machine for closing of each bag and simultaneous attachment of the multiple tags by sewing the bag and the multiple tags together along edges of the bag at an opening thereof, the tag feeding apparatus comprising:

a tag spreader arranged to receive a stack of tags comprising a plurality of different tags that are distinct from one another and stacked together in a face-to-face grouping and arranged to displace the different tags relative to one another along faces of the tags to project each tag partially outward from an adjacent tag next thereto in the grouping of tags; and a tag stacker from which the tag spreader receives the stack of tags, the tag stacker comprising a plurality of tag dispensers spaced along a conveyer and each arranged to deliver individual tags one at a time from a source of a respective one of the different tags onto a respective slotted tag tray above the conveyor, the conveyor having upward projections positioned thereon to move through slots in the trays under operation of the conveyor to force a first individual tag off the respective tray of a first tag dispenser and move the first individual tag onward beneath the respective tray of a second tag dispenser where the projections move the first and second individual tags onward together, forcing the second individual tag off the respective tray of the second dispenser onto the first individual tag below.

24. The tag feeding apparatus of claim 23 wherein the trays and surfaces onto which the first individual tag falls from the respective tray of the first tag dispenser slope downwardly away from the tag dispensers to position the tags against wall portions projecting upward from the trays and the surfaces at distances from the dispensers to define guides for aligning edges of the tags prior to receipt thereof by the tag spreader.

25. The tag feeding apparatus according to claim 24 wherein the conveyor comprises at least one endless flexible element entrained about rotatable members and the surfaces onto which the first tag falls are defined above the conveyor and separated along the conveyor by one or more additional slots through which the projections extend upward to contact and move the tags.

26. The tag feeding apparatus according to claim 25 wherein each flexible element comprises a chain and the rotatable members comprise sprockets.

27. The tag feeding apparatus according to claim 23 wherein the conveyor and the tag spreader are both coupled to a common motor for driven operation thereby.

* * * * *